US009946219B2

(12) United States Patent
Mori et al.

(10) Patent No.: US 9,946,219 B2
(45) Date of Patent: Apr. 17, 2018

(54) IMAGE FORMING APPARATUS PROVIDED WITH HEATING UNIT AND PRESSURE ROLLER

(71) Applicant: Brother Kogyo Kabushiki Kaisha, Nagoya-shi, Aichi-ken (JP)

(72) Inventors: Hiroki Mori, Nagoya (JP); Hiroshi Handa, Inazawa (JP); Tatsuo Ogasawara, Kasugai (JP); Takuji Matsuno, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/009,122

(22) Filed: Jan. 28, 2016

(65) Prior Publication Data

US 2016/0231681 A1 Aug. 11, 2016

(30) Foreign Application Priority Data

Feb. 6, 2015 (JP) ..... 2015-022600

(51) Int. Cl.
*G03G 21/16* (2006.01)
*G03G 15/20* (2006.01)

(52) U.S. Cl.
CPC ..... *G03G 21/1647* (2013.01); *G03G 15/206* (2013.01); *G03G 2215/2035* (2013.01)

(58) Field of Classification Search
CPC ..... G03G 15/2017
See application file for complete search history.

(56) References Cited

U.S. PATENT DOCUMENTS

| | | | | |
|---|---|---|---|---|
| 9,454,118 | B2 | 9/2016 | Tanaka et al. | |
| 9,703,242 | B2 | 7/2017 | Tanaka et al. | |
| 2002/0168202 | A1* | 11/2002 | Izawa | G03G 15/0818 399/286 |
| 2005/0008411 | A1* | 1/2005 | Chung | G03G 15/2064 399/328 |
| 2010/0226700 | A1* | 9/2010 | Yamada | G03G 15/2089 399/329 |

(Continued)

FOREIGN PATENT DOCUMENTS

| | | | |
|---|---|---|---|
| JP | 2012155070 A | * | 8/2012 |
| JP | 2014-178486 A | | 9/2014 |
| JP | 2015-087752 A | | 5/2015 |

OTHER PUBLICATIONS

JP_2012155070_A_T, Naruse, Japan, 2012.*

*Primary Examiner* — Victor Verbitsky
(74) *Attorney, Agent, or Firm* — Banner & Witcoff, Ltd.

(57) ABSTRACT

An image forming apparatus includes: a heating unit; a pressure roller; a first frame supporting the heating unit; a second frame engaging the first frame; a first gear; a second gear; and a fixing member. The second frame supports a shaft portion of the pressure roller. The first gear is provided at one end of the shaft portion and rotatable with the pressure roller. The second gear engages the first gear and transmits a drive force to the first gear. The fixing member has a first portion engaging the shaft portion and a second portion engaging the second frame. At least a part of the first portion engages the shaft portion at a position on a downstream side of the shaft portion in a second direction in which the shaft portion receives a force upon transmission of the drive force.

18 Claims, 12 Drawing Sheets

(56) References Cited

U.S. PATENT DOCUMENTS

| | | | | |
|---|---|---|---|---|
| 2013/0071155 | A1* | 3/2013 | Suzuki | G03G 15/2064 399/329 |
| 2015/0093164 | A1 | 4/2015 | Tanaka et al. | |
| 2016/0363895 | A1 | 12/2016 | Tanaka et al. | |

* cited by examiner

IMAGE FORMING APPARATUS PROVIDED WITH HEATING UNIT AND PRESSURE ROLLER

CROSS REFERENCE TO RELATED APPLICATION

This application claims priority from Japanese Patent Application No. 2015-022600 filed Feb. 6, 2015. The entire content of the priority application is incorporated herein by reference.

TECHNICAL FIELD

The present disclosure relates to an electrophotographic type image forming apparatus.

BACKGROUND

Hitherto, there is known an image forming apparatus including a pressure roller and a fusing belt that is disposed so as to be in pressure contact with the pressure roller. In the image forming apparatus, the pressure roller rotates upon transmission of a drive force to a gear provided at a shaft of the pressure roller, and the fusing belt rotates in accordance with the rotation of the pressure roller. In this image forming apparatus, there is a case where the pressure roller moves toward the fusing belt in a direction that the pressure roller faces the fusing belt when the drive force is transmitted to the gear of the pressure roller.

In order to solve such a problem, there is known an image forming apparatus including a spring that applies an urging force to a shaft of a pressure roller. The spring urges the shaft of the pressure roller so that the pressure roller moves away from a fusing belt in a direction that the pressure roller faces the fusing belt.

SUMMARY

However, in such an image forming apparatus, the pressure roller is normally urged by the spring in a direction away from the fusing belt. The pressure roller is likely to move relative to the fusing belt, which causes change in pressure state between the pressure roller and the fusing belt.

In view of the foregoing, it is an object of the disclosure to provide an image forming apparatus capable of stably maintaining a pressure state between a pressure roller and an endless belt.

In order to attain the above and other objects, according to one aspect, the disclosure provides an image forming apparatus including: a heating unit; a pressure roller; a first frame; a second frame; a first gear; a second gear; and a fixing member. The heating unit includes a heater and extends in a first direction. The pressure roller includes a shaft portion and a roller portion. The shaft portion extends in the first direction and has one end portion in the first direction. The shaft portion has an outer peripheral surface. The roller portion covers the outer peripheral surface of the shaft portion. The pressure roller is configured to convey a recording medium between the heating unit and the roller portion in a conveying direction. The first frame supports the heating unit. The second frame engages with the first frame and supports the shaft portion. The first gear is provided at the one end portion of the shaft portion and configured to rotate with the pressure roller. The second gear meshedly engages with the first gear and is configured to transmit a drive force to the first gear. The fixing member has a first portion engaging with the shaft portion and a second portion engaging with the second frame. At least a part of the first portion engages with the shaft portion at a position on a downstream side of the shaft portion in a second direction in which the shaft portion receives a force upon transmission of the drive force from the second gear to the first gear.

According to another aspect, the disclosure provides an image forming apparatus including: a heating unit; a pressure roller; a bearing portion; a first frame; a second frame; and a fixing member. The heating unit includes a heater and extends in a first direction. The pressure roller includes a shaft portion and a roller portion. The shaft portion extends in the first direction and has an outer peripheral surface. The roller portion covers the outer peripheral surface of the shaft portion. The pressure roller is configured to convey a recording medium between the heating unit and the roller portion. The bearing portion rotatably supports the shaft portion. The first frame supports the heating unit. The second frame engages with the first frame and includes a support portion supporting the bearing portion. The fixing member has a first portion engaging with the bearing portion in a state where the bearing portion is supported by the support portion, and a second portion engaging with the second frame.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
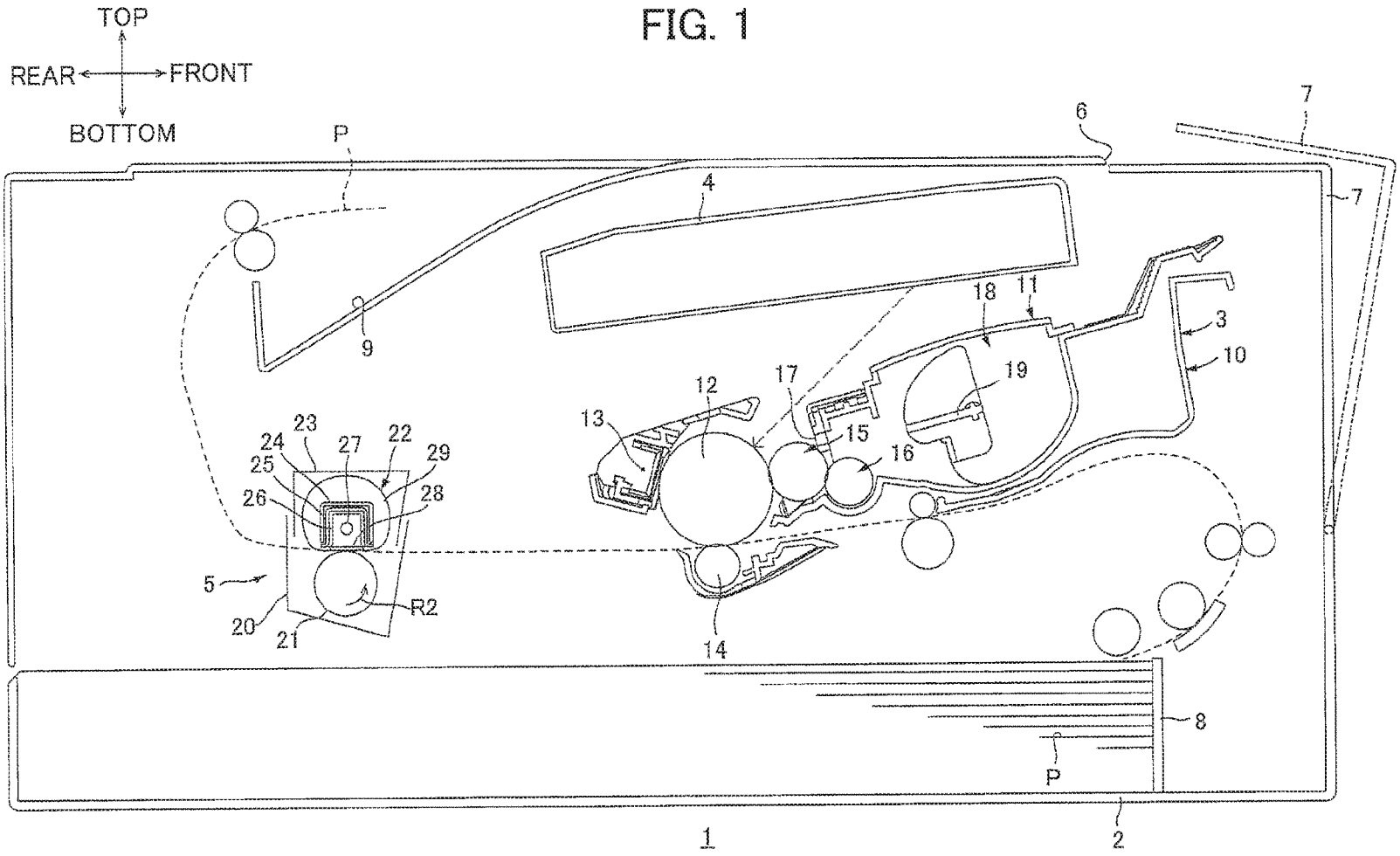
FIG. 1 is a cross-sectional view of a printer according to a first embodiment of the present disclosure.

A printer as an image forming apparatus according to a first embodiment of the disclosure will be described with reference to the accompanying drawings, wherein like parts and components are designated by the same reference numerals to avoid duplicating description.

1. Overall Structure of Printer

As illustrated in FIG. 1, the printer 1 is an electrophotographic type monochromatic printer. The printer 1 includes a main casing 2, a process cartridge 3, a scanner unit 4, and a fixing unit 5.

Directions in the following description will be based on an assumption that the printer 1 is disposed in a horizontal orientation in which it is intended to be used. Specifically, a top side of the printer 1 in FIG. 1 will be referred to as a top side, and a bottom side of the printer 1 in FIG. 1 will be referred to as a bottom side. Further, a right side of the printer 1 in FIG. 1 will be referred to as a front side, and a left side of the printer 1 in FIG. 1 will be referred to as a rear side. A left side and a right side of the printer 1 will be based on a reference point of a user viewing the printer 1 from front side. That is, a near side in FIG. 1 will be referred to as a left side, and a far side in FIG. 1 will be referred to as a right side.

The main casing 2 is generally box-shaped. The main casing 2 has an opening portion 6, a front cover 7, a sheet supply tray 8, and a sheet discharge tray 9.

The opening portion 6 is formed at a front end portion of the main casing 2. The opening portion 6 allows communication between an exterior and an interior of the main casing 2 in a front-rear direction so as to allow the process cartridge 3 to pass through the opening portion 6.

The front cover 7 is provided at the front end portion of the main casing 2. The front cover 7 has a plate like configuration that is generally L-shaped in side cross-section. The front cover 7 has a lower end portion pivotally movably supported to a front wall of the main casing 2 for opening and closing the opening portion 6.

The sheet supply tray 8 is provided in a bottom portion of the main casing 2. The sheet supply tray 8 is configured to accommodate a stack of sheets P as an example of a recording medium.

The sheet discharge tray 9 is disposed at an upper wall of the main casing 2. The sheet discharge tray 9 is recessed downward from the upper wall so as to receive the sheets P.

The process cartridge 3 is accommodated in a substantially vertical center portion of the main casing 2. The process cartridge 3 is configured to be attached to and detached from the main casing 2 through the opening portion 6. The process cartridge 3 includes a drum cartridge 10, and a developing cartridge 11.

The drum cartridge 10 includes a photosensitive drum 12, a scorotron charger 13, and a transfer roller 14.

The photosensitive drum 12 is formed in a generally cylindrical shape that extends in a left-right direction as an example of a first direction. The photosensitive drum 12 is rotatably supported to a rear end portion of a frame of the drum cartridge 10.

The scorotron charger 13 is disposed rearward of and spaced apart from the photosensitive drum 12.

The transfer roller 14 is disposed below the photosensitive drum 12. The transfer roller 14 is in contact with a lower end portion of the photosensitive drum 12.

The developing cartridge 11 is attached to the drum cartridge 10 at a position in front of the photosensitive drum 12. The developing cartridge 11 includes a developing roller 15, a supply roller 16, a layer thickness regulation blade 17, a toner chamber 18, and an agitator 19.

The developing roller 15 has a generally cylindrical shape that extends in the left-right direction. The developing roller 15 is rotatably supported to a rear end portion of a frame of the developing cartridge 11. The developing roller 15 is in contact with a front end portion of the photosensitive drum 12.

The supply roller 16 has a generally cylindrical shape that extends in the left-right direction. The supply roller 16 is disposed diagonally below and frontward of the developing roller 15. The supply roller 16 is rotatably supported to the frame of the developing cartridge 11. The supply roller 16 is in contact with a lower front end portion of the developing roller 15.

The thickness regulation blade 17 is disposed diagonally above and frontward of the developing roller 15. The layer thickness regulation blade 17 is in contact with a front end portion of the developing roller 15.

The toner chamber 18 is disposed frontward of the supply roller 16 and the layer thickness regulation blade 17. The toner chamber 18 is configured to accommodate toner therein.

The agitator 19 is rotatably supported in the toner chamber 18.

The scanner unit 4 is disposed above the process cartridge 3. The scanner unit 4 is configured to emit a laser beam based on image data toward the photosensitive drum 12.

The fixing unit 5 is disposed in a rear portion of the main casing 2. The fixing unit 5 includes a pressure roller 21 and a heating unit 22.

The pressure roller 21 has a generally cylindrical shape that extends in the left-right direction.

The heating unit 22 is disposed above the pressure roller 21 and faces the pressure roller 21 in a vertical direction. The heating unit 22 includes a stay cover 24, a stay 25, a reflection plate 26, a halogen lamp 27 as an example of a heater, a nip plate 28, and an endless belt 29.

The stay cover 24 is made from a heat resistant resin. The stay cover 24 has a generally box shape that is open on its bottom end and extends in the left-right direction.

The stay 25 is disposed inward of the stay cover 24. The stay 25 is made from a metal. The stay 25 has a generally prismatic tubular shape that is open on its bottom end and extends in the left-right direction.

The reflection plate 26 is disposed inward of the stay 25. The reflection plate 26 is made from a metal. The reflection plate 26 is generally prismatic tubular shape that is open on its bottom end and extends in the left-right direction. The reflection plate 26 has an inner surface that is subjected to mirror-surface finishing.

The halogen lamp 27 is disposed inward of the reflection plate 26. The halogen lamp 27 has a generally cylindrical shape that extends in the left-right direction. The halogen lamp 27 is configured to generate radiant heat upon electric power supply.

The nip plate 28 is disposed below the halogen lamp 27. The nip plate 28 is made from a metal. The nip plate 28 has a generally flat plate-like shape that extends in the left-right direction.

The endless belt 29 is made from a film having heat resistivity and flexibility. The endless belt 29 is a generally hollow cylindrical shape that extends in the left-right direction. The endless belt 29 provides an internal space in which the stay cover 24, the stay 25, the reflection plate 26, the halogen lamp 27, and the nip plate 28 are disposed such that an inner peripheral surface of the endless belt 29 is in contact with a lower surface of the nip plate 28. The endless belt 29 has a lower end portion that is in contact with an upper end portion of the pressure roller 21.

Upon start of an image forming operation in the printer 1, the scorotron charger 13 applies a uniform charge to a surface of the photosensitive drum 12, after which the scanner unit 4 irradiates a laser beam to expose the surface of the photosensitive drum 12 to light based on image data. An electrostatic latent image is thus formed on the surface of the photosensitive drum 12 based on the image data.

The agitator 19 agitates toner accommodated in the toner chamber 18 and supplies the toner to the supply roller 16. The toner is then supplied to the developing roller 15 from the supply roller 16. At this time, the toner is subjected to triboelectric charging with positive polarity between the developing roller 15 and the supply roller 16, so that the toner is carried on the developing roller 15. A thickness of the toner layer on the developing roller 15 is uniformly regulated by the layer thickness regulation blade 17.

The toner carried on the developing roller 15 is then supplied to the electrostatic latent image formed on the surface of the photosensitive drum 12, thereby forming a toner image on the surface of the photosensitive drum 12.

Each sheet P is successively conveyed by various rollers from the sheet supply tray 8 to a position between the photosensitive drums 12 and the transfer roller 14 at a prescribed timing. The toner image formed on the surface of the photosensitive drum 12 is transferred onto the sheet P when the sheet P passes through the photosensitive drum 12 and the transfer roller 14.

Then, the sheet P is subjected to heat and pressure when the sheet P passes through the pressure roller 21 and the heating unit 22. Thus, the toner image transferred onto the sheet P is thermally fixed to the sheet P.

Thereafter, the sheet P is discharged onto the sheet discharge tray 9.

2. Detailed Description of Fixing Unit

Figure 2:
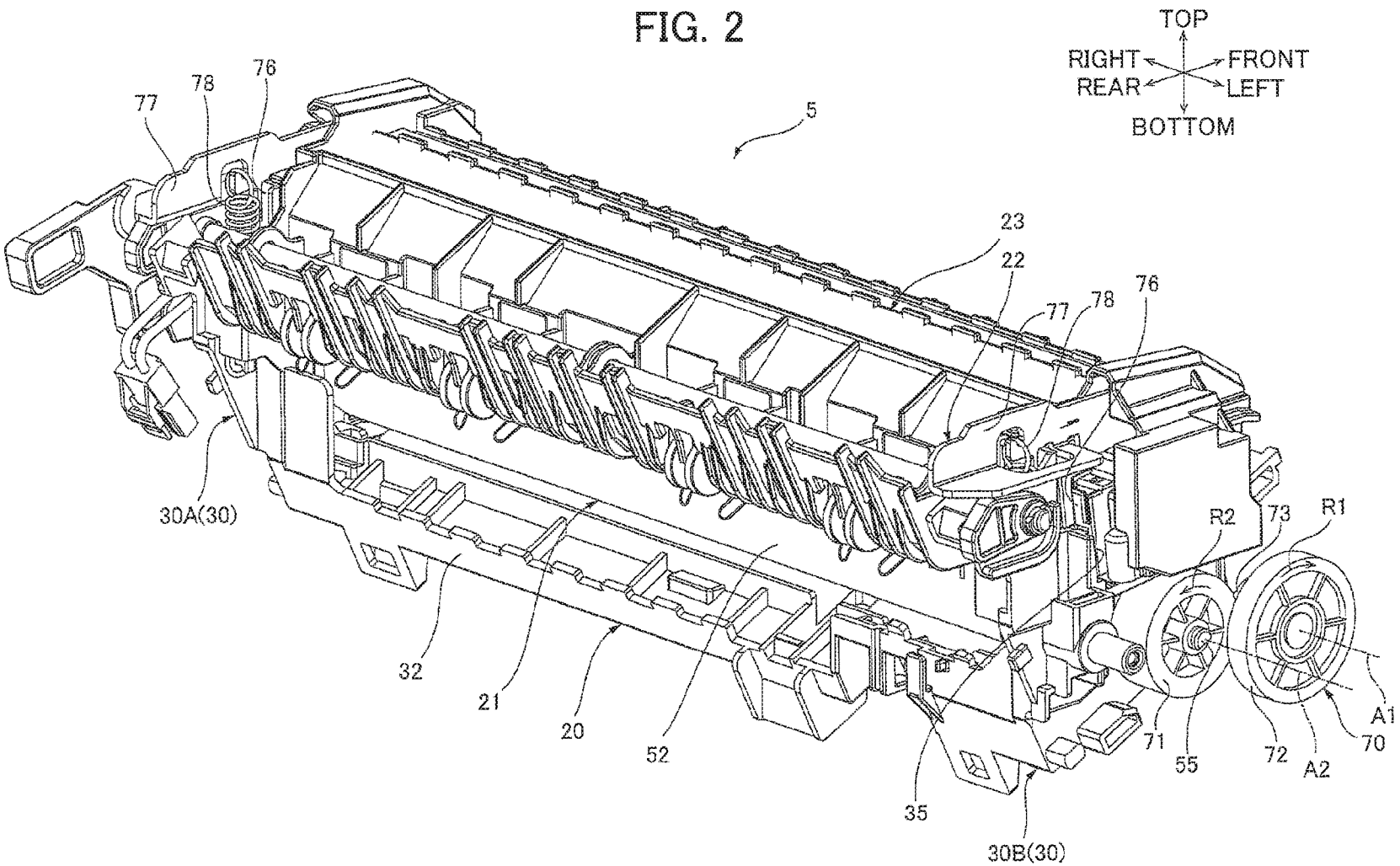
FIG. 2 is a perspective view of a fixing unit provided in the printer illustrated in FIG. 1.
Figure 3A:
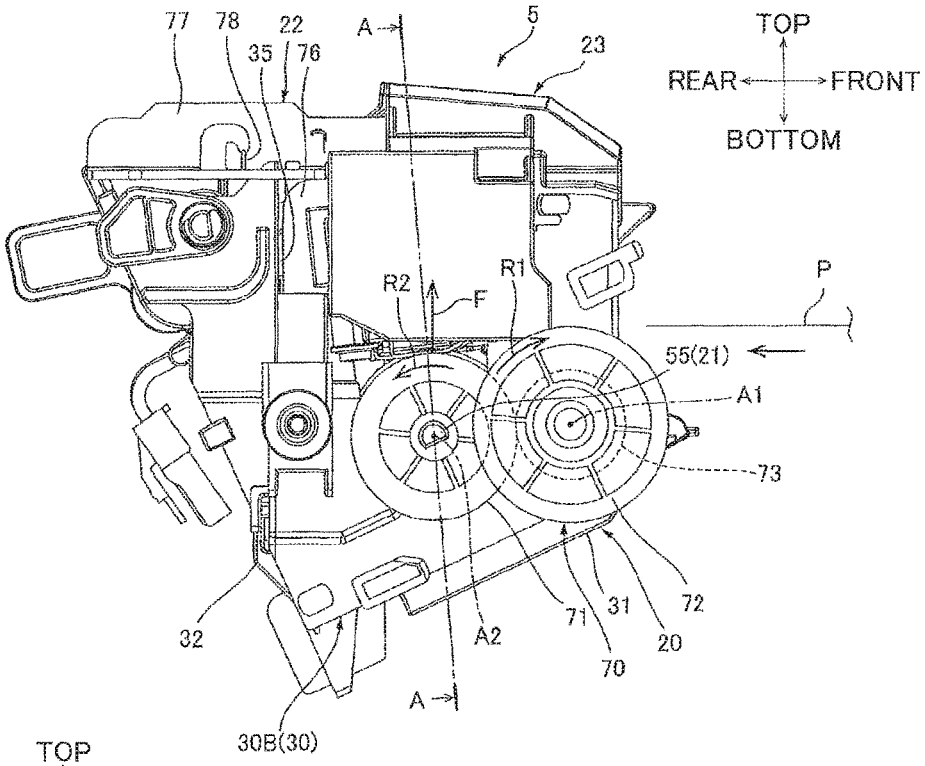
FIG. 3A is a left side view of the fixing unit illustrated in FIG. 2.
Figure 3B:
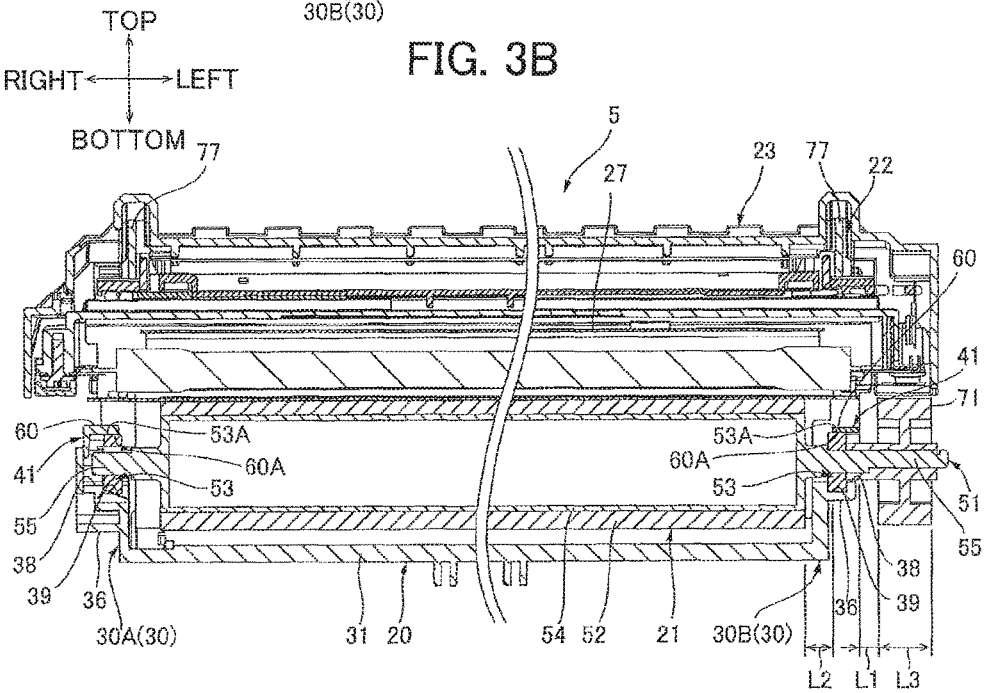
FIG. 3B is a cross-sectional view of the fixing unit taken along a line A-A in FIG. 3A.

The fixing unit 5 includes, as illustrated in FIGS. 2 and 3B, a lower frame 20 as an example of a second frame, the pressure roller 21, a pair of fixing members 41, a drive gear 70, the heating unit 22, and an upper frame 23 as an example of a first frame.

(1) Lower Frame

Figure 4:
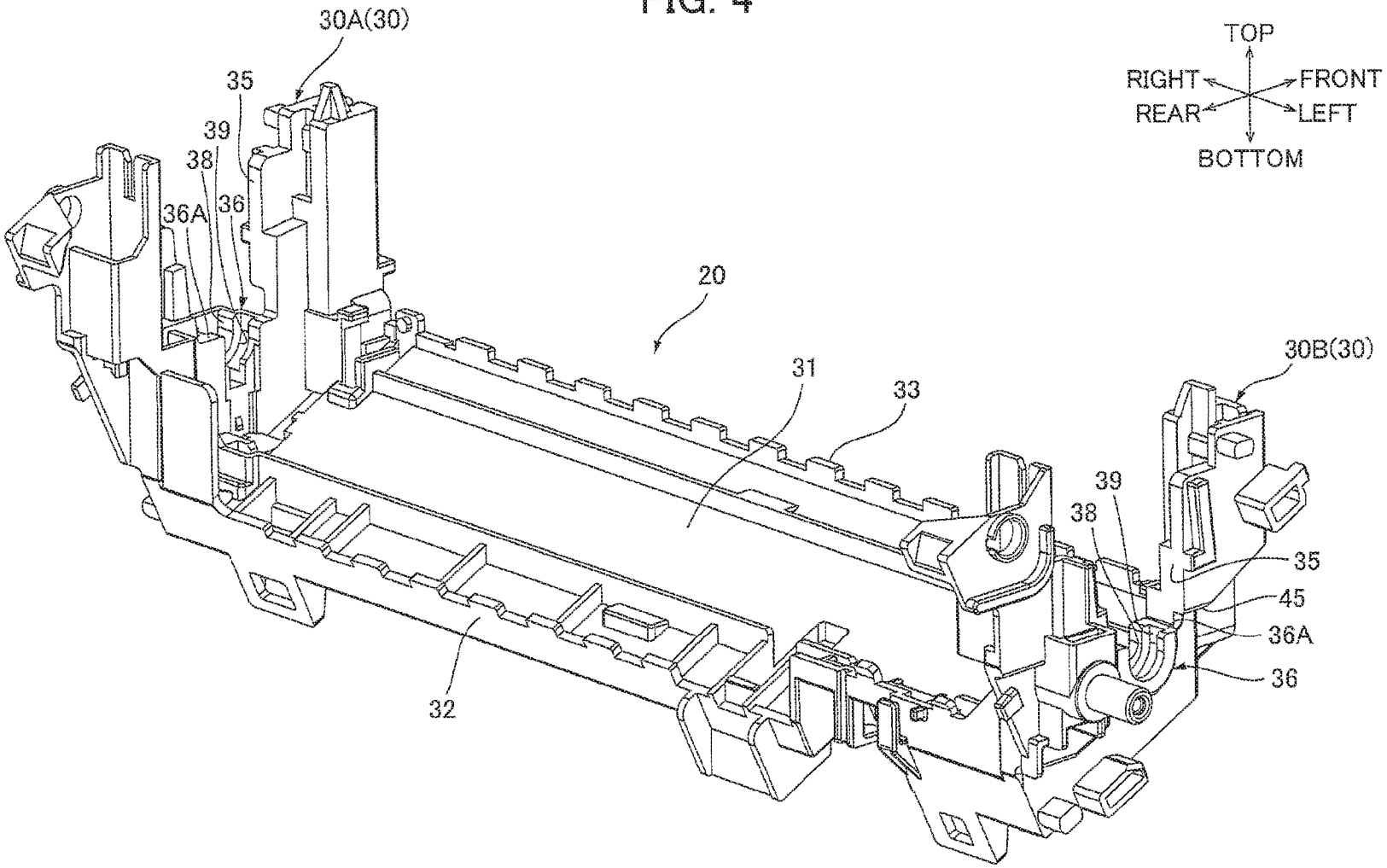
FIG. 4 is a perspective view of a lower frame of the fixing unit illustrated in FIG. 2.

As illustrated in FIG. 4, the lower frame 20 has a bottomed frame-like shape that is open on the top. The lower frame 20 includes a pair of side walls 30, a bottom wall 31, a front wall 33, and a rear wall 32.

The pair of side walls 30 is respectively disposed at both end portions of the lower frame 20 in the left-right direction. The pair of side walls 30 is disposed so as to be spaced apart from each other in the left-right direction. Each of the pair of side walls 30 has a substantially plate shape that is substantially rectangular in a side view. Each of the pair of side walls 30 includes a first concave portion 35, a support portion 36, and a pair of step surfaces 45. Incidentally, one of the pair of the side walls 30 disposed at the right side will be referred to as a right side wall 30A, and the other of the pair of side walls 30 disposed at the left side will be referred to as a left side wall 30B when it is necessary to distinguish between the two.

The first concave portion 35 is recessed downward from an upper end of the side wall 30 at its front-rear center portion. The first concave portion 35 has a substantial U-shape in a side view with the opening of the "U" facing upward. A lower end of the first concave portion 35 is disposed at a vertical center portion of the side wall 30.

The support portion 36 is disposed below the first concave portion 35. The support portion 36 protrudes outward in the left-right direction from an outer left-right surface of the side wall 30. The support portion 36 has a semi-circular shape in a side view and has a circumferential surface formed at a lower end thereof. An upper surface of the support portion 36 serves as a bottom surface of the first concave portion 35. The support portion 36 includes a second concave portion 38 and a third concave portion 39.

The second concave portion 38 is recessed downward from an upper surface of the support portion 36. The second concave portion 38 has a substantial U-shape in a side view with the opening of the "U" facing upward.

The third concave portion 39 is disposed at a left-right center portion of the support portion 36. The third concave portion 39 is recessed outward in a radial direction of the support portion 36 from an inner surface of the second concave portion 38 and extends in a circumferential direction of the support portion 36. A length of the third concave portion 39 in the left-right direction is shorter than a length of the second concave portion 38 in the left-right direction. The third concave portion 39 has a substantial U-shape in a side view with the opening of the "U" facing upward.

Figure 7:
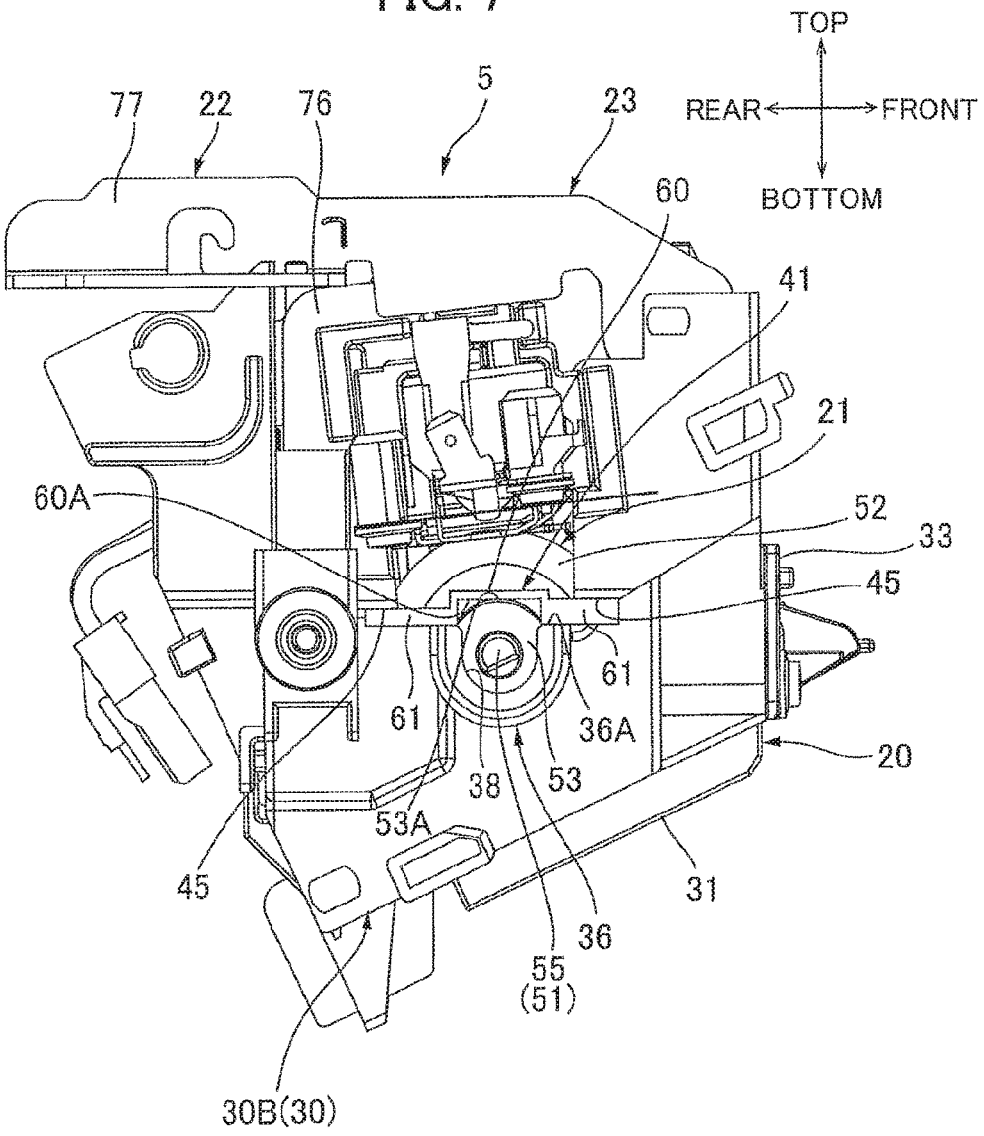
FIG. 7 is a left side view of the lower frame and the fixing member illustrated in FIG. 6.

As illustrated in FIG. 7, the pair of step surfaces 45 is respectively disposed at both sides of the support portion 36 in the front-rear direction at a position above the support portion 36. Specifically, as illustrated in FIG. 4, each of the pair of side walls 30 is formed so that an upper half portion of the side wall 30 is disposed outward in the left-right direction of a lower half portion of the side wall 30. The upper half portion of the side wall 30 is an example of a projecting portion. As illustrated in FIG. 7, lower surfaces of the upper half portion of each of the pair of side walls 30 serve as the pair of step surfaces 45.

The bottom wall 31 bridges lower ends of the pair of side walls 30. The bottom wall 31 has a substantially plate shape that is substantially rectangular in a plan view.

The rear wall 32 bridges rear ends of the pair of side walls 30 and extends along a rear end of the bottom wall 31. The rear wall 32 has a substantially plate shape that is substantially rectangular in a rear view. A right end of the rear wall 32 is continuous to a rear end of the right side wall 30A at a lower end thereof, while a left end of the rear wall 32 is continuous to a rear end of the left side wall 30B at a lower end thereof. A lower end of the rear wall 32 is continuous to the rear end of the bottom wall 31.

The front wall 33 bridges front ends of the pair of side walls 30 and extends along a front end of the bottom wall 31. The front wall 33 has a substantially plate shape that is substantially rectangular in a front view. A right end of the front wall 33 is continuous to a front end of the right side wall 30A at a lower end thereof, while a left end of the front wall 33 is continuous to a front end of the left side wall 30B at a lower end thereof. A lower end of the front wall 33 is continuous to the front end of the bottom wall 31.

(2) Pressure Roller

Figure 5:
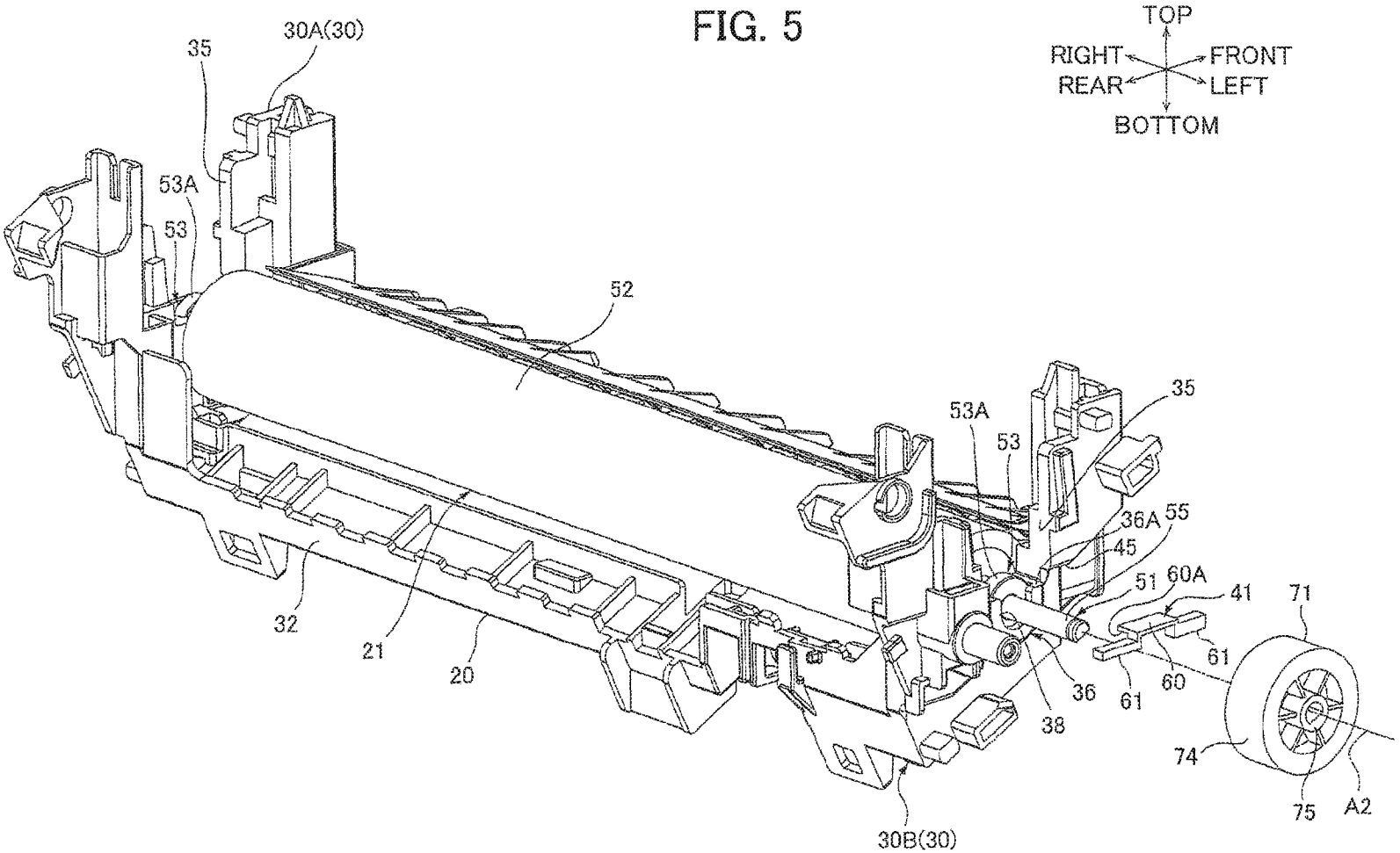
FIG. 5 is a perspective view of the lower frame illustrated in FIG. 4 to which a pressure roller is assembled.

As illustrated in FIGS. 3B and 5, the pressure roller 21 includes a shaft portion 51, a roller portion 52, a pair of bearing portions 53, and a pressure gear 71 as an example of a first gear.

The shaft portion 51 is formed of metal and has a substantially columnar shape extending in the left-right direction. The shaft portion 51 includes a large diameter portion 54 and a pair of small diameter portions 55.

The large diameter portion 54 has a substantially hollow columnar shape extending in the left-right direction.

The pair of small diameter portions 55 respectively extends outward in the left-right direction from both end-faces of the large diameter portion 54 in the left-right direction at center portions thereof. Each of the pair of small diameter portions 55 has a substantially columnar shape extending in the left-right direction. A diameter of each of the pair of small diameter portions 55 is smaller than a diameter of the large diameter portion 54.

The roller portion 52 is formed of resin and covers an outer peripheral surface of the large diameter portion 54 of the shaft portion 51. The roller portion 52 has a substantially cylindrical shape extending in the left-right direction.

The pair of bearing portions 53 is respectively disposed inside the third concave portions 39 of the support portions 36 of the pair of side walls 30. Each of the pair of bearing portions 53 has a substantially annular shape with a thickness in the left-right direction. An upper end portion of each of the pair of bearing portions 53 is exposed upward from the support portion 36 of each of the pair of side walls 30. The inner diameter of each of the pair of bearing portions 53 is substantially equal to the outer diameter of each of the pair of small diameter portions 55. The outer diameter of each of the pair of bearing portions 53 is substantially equal to the outer diameter of the third concave portion 39 of each of the pair of support portions 36. The length of each of the pair of bearing portions 53 in the left-right direction is substantially equal to the length of the third concave portion 39 of each of the pair of support portions 36 in the left-right direction. The pair of bearing portions 53 is respectively fitted with the pair of small diameter portions 55 so as to be rotatable relative thereto. Accordingly, the pair of bearing portions 53 rotatably supports the shaft portion 51. Hence, the pressure roller 21 is rotatably supported to the lower frame 20.

The pressure gear 71 has a substantially cylindrical shape with a thickness in the left-right direction. Specifically, the pressure gear 71 includes a gear portion 74 and a shaft receiving portion 75. The gear portion 74 has a substantially cylindrical shape with a thickness in the left-right direction. Gear teeth are provided on an outer peripheral surface in its entirety of the gear portion 74. The pressure gear 71 is assembled to the shaft portion 51 such that the shaft receiving portion 75 receives a left end portion of the shaft portion 51, that is, the left small diameter portion 55, of the pressure roller 21 so as not to be rotatable relative thereto. With this configuration, the pressure gear 71, the shaft portion 51, and the roller portion 52 are integrally rotated about a rotation axis A2 extending in the left-right direction. The pressure gear 71 rotates about the rotation axis A2.

(3) Fixing Member

Figure 6:
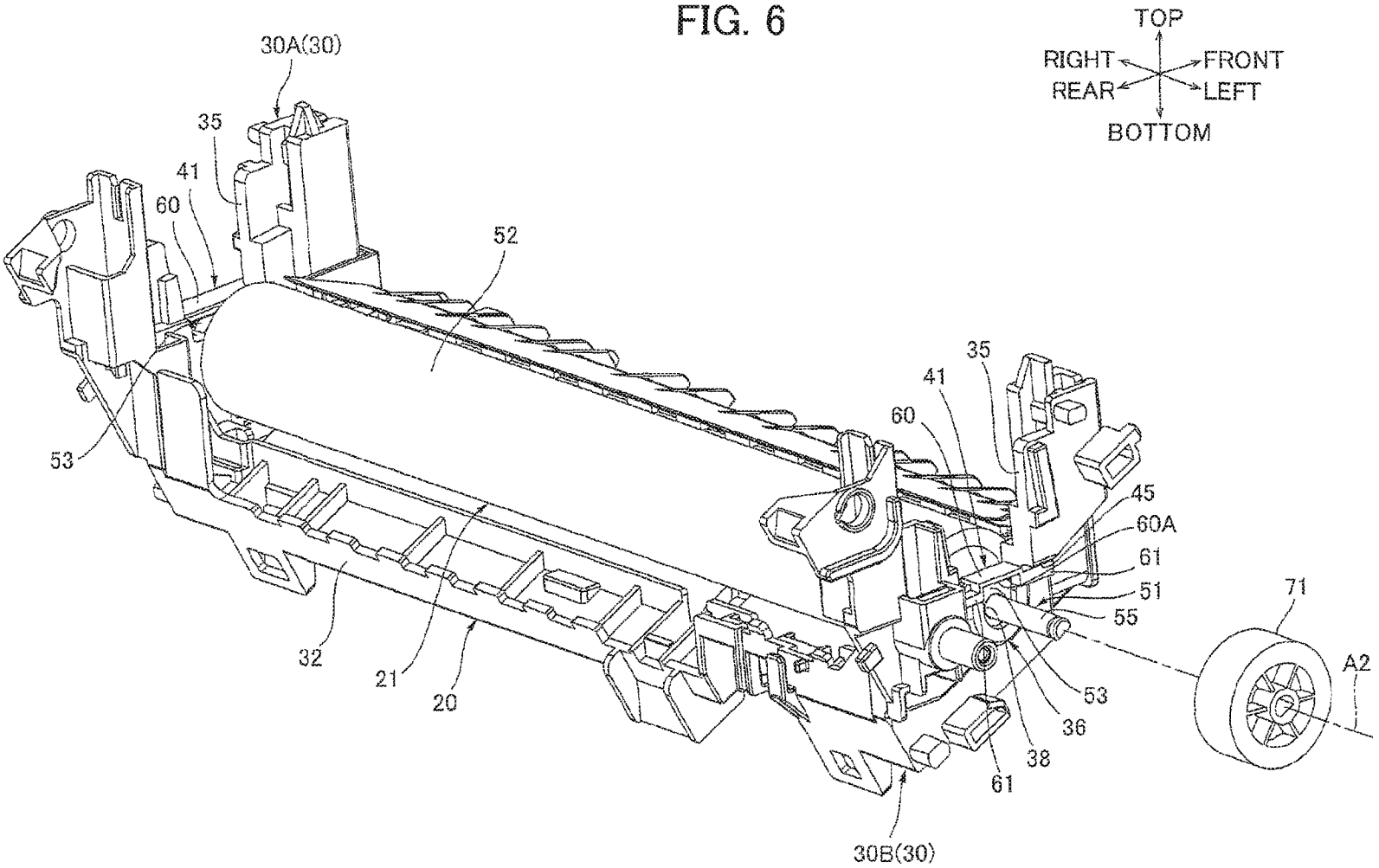
FIG. 6 is a perspective view of the lower frame illustrated in FIG. 5 to which a pair of fixing members is assembled.

As illustrated in FIG. 6, the pair of fixing members 41 is respectively disposed above the pair of small diameter portions 55 of the shaft portion 51. Note that one of the pair of fixing members 41 disposed above the left small diameter portion 55 will also be referred to as a left fixing member 41, while the other of the pair of fixing members 41 disposed above the right small diameter portion 55 will also be referred to as a right fixing member 41 when it is necessary to distinguish between the two. Each of the pair of fixing members 41 has a substantial bar shape extending in the front-rear direction and has a substantially hat shape in a side view. Each of the pair of fixing members 41 includes a contact portion 60 as an example of a first portion and a pair of attachment portions 61 as an example of a second portion.

The contact portion 60 has a substantially plate shape that is substantially rectangular in a plan view. A dimension of the contact portion 60 in the front-rear direction is smaller than a dimension of the support portion 36 of the side wall 30 in the front-rear direction and is larger than a dimension of the bearing portion 53 of the pressure roller 21 in the front-rear direction, as illustrated in FIG. 7. The contact portion 60 is disposed above the bearing portion 53 such that a lower surface 60A of the contact portion 60 contacts an upper surface 53A of the bearing portion 53 of the pressure roller 21. In other words, the contact portion 60 engages with the shaft portion 51 through the bearing portion 53.

The pair of attachment portions 61 respectively extends outward in the front-rear direction from both edges of the contact portion 60 in the front-rear direction. That is, the pair of attachment portions 61 is disposed at both sides of the contact portion 60 in the front-rear direction. In other words, the contact portion 60 is disposed between the attachment portions 61 in the front-rear direction. Each of the pair of attachment portions 61 has a substantial prismatic columnar shape extending in the front-rear direction. An upper surface of each of the pair of attachment portions 61 is connected to the lower surface of the contact portion 60. Specifically, a rear end of the attachment portion 61 disposed at the front side (hereinafter referred to as a front attachment portion 61 when necessary) is continuous to a front end of the lower surface of the contact portion 60 at an outer left-right end portion thereof. A front end of the attachment portion 61 disposed at the rear side (hereinafter referred to as a rear attachment portion 61 when necessary) is continuous to a rear end of the lower surface of the contact portion 60 at an outer left-right end portion thereof.

As illustrated in FIG. 7, the pair of attachment portions 61 of each of the pair of fixing members 41 is attached to an upper surface 36A of the support portion 36 of each of the pair of side walls 30. Specifically, a rear end portion of the front attachment portion 61 is attached to a front end potion of the upper surface 36A of the support portion 36. A front end portion of the rear attachment portion 61 is attached to a rear end portion of the upper surface 36A of the support portion 36. Further, upper surfaces of the pair of attachment portions 61 are respectively in contact with the pair of step surfaces 45. Specifically, an upper surface of a front end portion of the front attachment portion 61 is in contact with the front step surface 45. An upper surface of a rear end portion of the rear attachment portion 61 is in contact with the rear step surface 45. Hence, the front attachment portion 61 and the rear attachment portion 61 respectively engage with the upper half portion of the side walls 30 at positions offset from the contact portion 60 in the front-rear direction.

Incidentally, one of the pair of attachment portions 61 disposed at the front side, that is, the front attachment portion 61, is disposed at an upstream side of the contact portion 60 in a conveying direction of the sheet P, while the other of the pair of attachment portions 61 disposed at the rear side, that is, the rear attachment portion 61, is disposed at a downstream side of the contact portion 60 in the conveying direction.

Further, as illustrated in FIG. 3B, the left fixing member 41 is disposed closer to the pressure gear 71 than to the left-right center portion of the shaft portion 51. More specifically, the left fixing member 41 is disposed between the pressure gear 71 and the roller portion 52. A first distance L1 from a left edge of the left fixing member 41 to a right end face of the gear portion 74 of the pressure gear 71 is shorter than a second distance L2 from a right edge of the left fixing member 41 to a left edge of the roller portion 52 of the pressure roller 21. Further, the distance L1 is shorter than a thickness L3 of the gear portion 74 of the pressure gear 71 in the left-right direction.

(4) Drive Gear

As illustrated in FIGS. 2 and 3A, the drive gear 70 as an example of a second gear is disposed frontward of the pressure gear 71.

The drive gear 70 has a substantially columnar shape with a thickness in the left-right direction. The drive gear 70 integrally includes a large diameter gear portion 72 and a small diameter gear portion 73.

The large diameter gear portion 72 constitutes a left end portion of the drive gear 70. The large diameter gear portion 72 has a substantially columnar shape with a thickness in the left-right direction. Gear teeth are provided on an outer peripheral surface in its entirety of the large diameter gear portion 72.

The small diameter gear portion 73 protrudes rightward from a right surface of the large diameter gear portion 72. The small diameter gear portion 73 has a substantially cylindrical shape with a center axis shared with the large diameter gear portion 72. That is, the large diameter gear portion 72 and the small diameter gear portion 73 are coaxial with each other. An outer diameter of the small diameter gear portion 73 is smaller than an outer diameter of the large diameter gear portion 72. Gear teeth are provided on an outer peripheral surface in its entirety of the small diameter gear portion 73. A rear end portion of the small diameter gear portion 73 meshedly engages with a front end portion of the pressure gear 71.

The drive gear 70 receives a support shaft (not illustrated) provided in the main casing 2 so as to be rotatable relative thereto. The drive gear 70 is rotatably supported by the support shaft. Accordingly, the drive gear 70 is configured to rotate about a rotation axis A1 extending in the left-right direction. A direction from the rotation axis A2 of the pressure gear 71 toward the rotation axis A1 of the drive gear 70 is an example of a third direction.

(5) Heating Unit and Upper Frame

The heating unit 22 includes a pair of engagement portions 76, as illustrated in FIGS. 2 and 3A.

The pair of engagement portions 76 is respectively disposed at both end portions of the heating unit 22 in the left-right direction. Each of the pair of engagement portions 76 has a substantially plate shape that is substantially rectangular in a side view. A length of each of the pair of engagement portions 76 in the front-rear direction is substantially equal to a length of the first concave portion 35 of each of the pair of side walls 30 in the front-rear direction. Each of the pair of engagement portions 76 is fitted with the first concave portion 35 of the support portion 36 of each of the pair of side walls 30. Accordingly, the heating unit 22 is supported to the lower frame 20 so as to be slidable in the vertical direction.

The upper frame 23 has a substantial box shape that is open on the bottom. The upper frame 23 supports the heating unit 22 so as to covers the heating unit 22 from the top side. The upper frame 23 is provided with a pair of pressing members 77 and a pair of tension springs 78.

The pair of pressing members 77 is respectively disposed at both end portions of the upper frame 23 in the left-right direction. Each of the pair of pressing members 77 is disposed above each of the pair of engagement portions 76. Each of the pair of pressing members 77 has a substantial plate shape extending in the front-rear direction. One end of each of the pair of tension springs 78 engages with each of the pair of pressing members 77. The other end of each of the pair of tension springs 78 engages with the lower frame 20. With this configuration, the upper frame 23 engages with the lower frame 20. Accordingly, an urging force exerted toward the lower frame 20 is normally applied to each of the pair of pressing members 77, so that each of the pair of engagement portions 76 is pressed downward. That is, an urging force exerted toward the lower frame 20 is normally applied to the heating unit 22 through the pair of pressing members 77.

3. Operations of Fixing Unit

As illustrated in FIG. 1, when an image forming operation is started, in the fixing unit 5, the nip plate 28 is heated to a high temperature by the halogen lamp 27. Further, an external drive force is transmitted to the large diameter gear portion 72 of the drive gear 70.

As illustrated in FIG. 3A, upon transmission of the drive force, the drive gear 70 rotates in a rotation direction R1. Here, the rotation direction R1 is a clockwise rotation direction in a left side view.

As the drive gear 70 rotates, the pressure gear 71 rotates in a rotation direction R2 in accordance with the rotation of the drive gear 70. Here, the rotation direction R2 is a counter-clockwise rotation direction in a left side view.

As illustrated in FIG. 1, the endless belt 29 circularly moves in accordance with the rotation of the pressure roller 21. Accordingly, the sheet P is conveyed in the conveying direction and enters into a position between the pressure roller 21 and the heating unit 22.

During this operation, as illustrated in FIG. 3A, the small diameter gear portion 73 of the drive gear 70 disposed frontward of the pressure gear 71 transmits the drive force to the pressure gear 71, causing a rotation of the pressure gear 71 in the rotation direction R2. At this time, a rear end portion of the small diameter gear portion 73 of the drive gear 70 moves upward, and hence, a front end portion of the pressure gear 71 moves upward. Accordingly, a force F exerted upward, that is, a force exerted toward the heating unit 22 is applied to the pressure gear 71. The upward force F is in turn applied to the shaft portion 51 to which the pressure gear 71 is attached. An upward direction is an example of a second direction.

Meanwhile, as illustrated in FIGS. 3B and 7, the upper surface 53A of each of the pair of bearing portions 53 of the pressure roller 21 is in contact with the lower surface 60A of the contact portion 60 of each of the pair of fixing members 41. Further, as illustrated in FIG. 7, each of the pair of attachment portions 61 of each of the pair of fixing members 41 is in contact with each of the pair of step surfaces 45 of each of the pair of side walls 30.

Therefore, as illustrated in FIGS. 3B and 7, upward movement of each of the pair of fixing members 41 is restricted by the pair of step surfaces 45. Accordingly, upward movement of each of the pair of bearing portions 53 is restricted. Particularly, the left fixing member 41 restricts the left bearing portion 53 from moving upward, thereby restricting the pressure roller 21 from moving upward.

In this way, the pressure roller 21 is fixed in a predetermined position in the vertical direction by the pair of fixing members 41. Hence, the pressure roller 21 is fixed in position relative to the heating unit 22.

Then, as illustrated in FIG. 3A, the sheet P approaches the fixing unit 5 from the front side thereof.

Figure 8B:
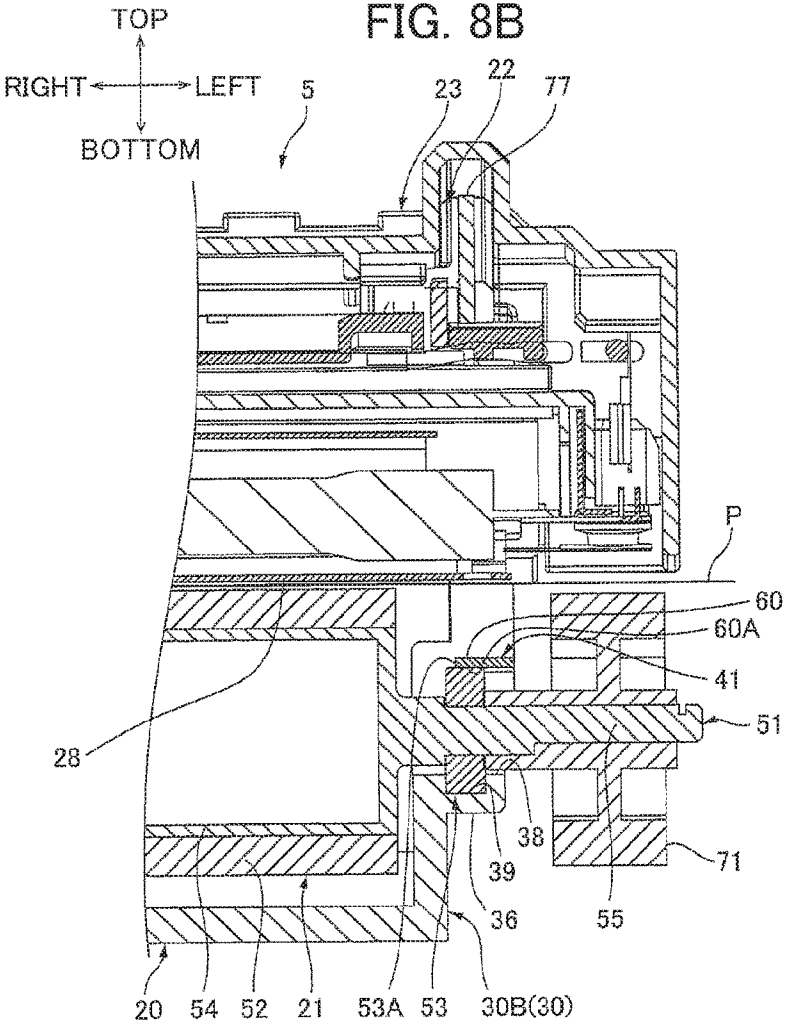
FIG. 8B is a cross-sectional view of the left end portion of the fixing unit illustrated in FIG. 2 as viewed from a rear side thereof, in which a sheet passes a gap between the heating unit and the pressure roller.
Figure 8A:
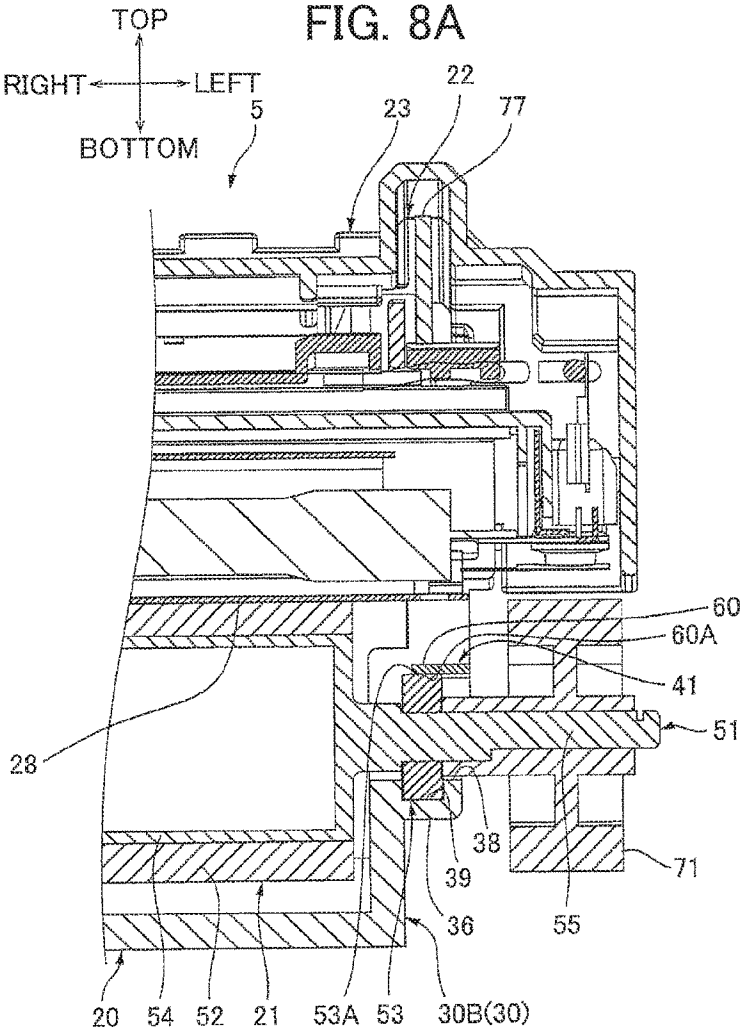
FIG. 8A is a cross-sectional view of a left end portion of the fixing unit illustrated in FIG. 2 as viewed from a rear side thereof, in which a heating unit and the pressure roller are in contact with each other.

Note that as illustrated in FIGS. 8A and 8B, the heating unit 22 is movable between a first position and a second position. FIG. 8A illustrates the first position of the heating unit 22 in the fixing unit 5. In the first position, the sheet P is not nipped between the pressure roller 21 and the heating unit 22, and the heating unit 22 is in pressure contact with the pressure roller 21. That is, the heating unit 22 is positioned close to the pressure roller 21 in the vertical direction.

FIG. 8B illustrates the second position of the heating unit 22 in the fixing unit 5. As illustrated in FIG. 8B, when the sheet P enters into a position between the pressure roller 21 and the heating unit 22, the heating unit 22 slides upward by the thickness of the sheet P from the first position against the urging force of the pair of tension springs 78. In the second position, the sheet P is nipped between the pressure roller 21 and the heating unit 22, and the heating unit 22 moves upward from the first position. That is, in the second position, the heating unit 22 is positioned away from the pressure roller 21 in the vertical direction farther than in the first position.

Then, the sheet P is heated by the nip plate 28, and is pressed between the pressure roller 21 and the endless belt 29.

Subsequently, the sheet P is discharged from the fixing unit 5 by the rotation of the pressure roller 21 and the endless belt 29.

Thereafter, as illustrated in FIG. 8A, the heating unit 22 moves downward by the urging force of the pair of tension springs 78, thereby being located at the first position.

4. Operational Effects (1) According to the printer 1, as illustrated in FIG. 6, each of the pair of fixing members 41 fixes the pressure roller 21 at a predetermined position in the vertical direction.

With this configuration, even when the upward force F is applied to the pressure roller 21 upon transmission of a drive force from the large diameter gear portion 72 to the pressure gear 71 through the small diameter gear portion 73, the pair of fixing members 41, particularly, the left fixing member 41, can fix the pressure roller 21 in the predetermined position.

Therefore, the pressure roller 21 is fixed in position relative to the heating unit 22. Thus, the pressure state between the pressure roller 21 and the heating unit 22 can be stably maintained.

Further, fixing of the pressure roller 21 in the predetermined position can result in fixing of the pressure gear 71 in a predetermined position.

Hence, improper engagement between the pressure gear 71 and the drive gear 70 can be suppressed.

Further, each of the pair of fixing members 41 engages with each of the pair of bearing portions 53 of the pressure roller 21.

With this configuration, the pressure roller 21 can be reliably fixed in the predetermined position relative to the heating unit 22 by each of the pair of fixing members 41.

(2) Further, according to the printer 1, as illustrated in FIG. 5, each pair of fixing members 41 includes the contact portion 60 and the pair of attachment portions 61. The contact portion 60 engages with the shaft portion 51 through the bearing portion 53 from above. The pair of attachment portions 61 engages with the lower frame 20.

Since the contact portion 60 engages with the shaft portion 51 through the bearing portion 53 and the pair of attachment portions 61 is attached to the lower frame 20, the pressure roller 21 can be fixed to the lower frame 20.

(3) Further, according to the printer 1, as illustrated in FIG. 5, in each pair of fixing members 41, the pair of attachment portions 61 is disposed at both sides of the contact portion 60 in the front-rear direction.

With this configuration, the contact portion 60 and the pair of attachment portions 61 can be disposed in a balanced manner in each of the pair of fixing members 41.

(4) Further, according to the printer 1, as illustrated in FIG. 4, each of the pair of side walls 30 includes the third concave portion 39 that is open on the top end. Further, each of the pair of bearing portions 53 is assembled to the third concave portion 39 of each of the pair of side walls 30 from above.

With this configuration, the pressure roller 21 can be easily assembled to the lower frame 20.

(5) Further, according to the printer 1, as illustrated in FIG. 3B, the left fixing member 41 is disposed closer to the pressure gear 71 than to the left-right center portion of the shaft portion 51 of the pressure roller 21. That is, the left fixing member 41 is disposed closer to the left end portion of the shaft portion 51 than to the left-right center portion of the shaft portion 51.

Here, when the drive gear 70 transmits the drive force to the pressure gear 71 and the force F is applied to the pressure roller 21, the force F is mainly exerted on the pressure gear 71.

Meanwhile, as described above, the left fixing member 41 can be disposed in the vicinity of the pressure gear 71, since the left fixing member 41 is disposed closer to the pressure gear 71 than to the left-right center portion of the shaft portion 51 of the pressure roller 21.

With this configuration, the pressure roller 21 is reliably fixed in position by the left fixing member 41. Hence, rattling of the pressure roller 21 can be suppressed.

(6) Further, according to the printer 1, as illustrated in FIG. 3B, the left fixing member 41 is disposed between the roller portion 52 of the pressure roller 21 and the pressure gear 71.

With this configuration, the left fixing member 41 can be disposed further in the vicinity of the pressure gear 71.

As a result, rattling of the pressure roller 21 can be further suppressed by the left fixing member 41.

(7) Further, according to the printer 1, as illustrated in FIG. 3B, the distance L1 from the left edge of the left fixing member 41 to the right end face of the gear portion 74 of the pressure gear 71 is shorter than the distance L2 from the right edge of the left fixing member 41 to the left edge of the roller portion 52 of the pressure roller 21.

With this configuration, the left fixing member 41 can be disposed further in the vicinity of the pressure gear 71.

As a result, rattling of the pressure roller 21 can be further suppressed by the left fixing member 41.

(8) Further, according to the printer 1, as illustrated in FIG. 3B, the distance L1 from the left edge of the left fixing member 41 to the right end face of the gear portion 74 of the pressure gear 71 is shorter than the thickness L3 of the gear portion 74 of the pressure gear 71 in the left-right direction.

With this configuration, the left fixing member 41 can be disposed further in the vicinity of the pressure gear 71.

As a result, rattling of the pressure roller 21 can be further suppressed by the left fixing member 41.

(9) Further, according to the printer 1, as illustrated in FIGS. 8A and 8B, the heating unit 22 is slidable in the vertical direction with respect to the lower frame 20. The heating unit 22 is slidably movable between the first position where the heating unit 22 is in pressure contact with the pressure roller 21 and the second position where the heating unit 22 is separated from the pressure roller 21 farther than in the first position.

Specifically, when the sheet P passes between the pressure roller 21 and the heating unit 22, the heating unit 22 is located at the second position.

With this configuration, the sheet P can be smoothly conveyed.

(10) Further, according to the printer 1, as illustrated in FIG. 1, the heating unit 22 includes the halogen lamp 27, the nip plate 28, and the endless belt 29.

With this configuration, the heating unit 22, more specifically, the nip plate 28 can reach a fixing temperature in a short time compared to a case where a heating unit includes a heating roller.

5. Second Through Fifth Embodiments

Referring to FIGS. 9A through 12B, printers according to second through fifth embodiments will be described.

(1) Second Embodiment

A second embodiment will be described while referring to FIGS. 9A through 9C, wherein like parts and components are designated with the same reference numerals to avoid duplicating description. In the following description, only parts differing from those of the first embodiment will be described in detail.

(1-1) Detailed Description of Fixing Unit According to Second Embodiment

In the first embodiment described above, the pair of fixing members 41 respectively contacts the pair of bearing portions 53 of the pressure roller 21. Each of the pair of fixing member 41 has a substantial bar shape and extends in the front-rear direction.

Figure 9A:
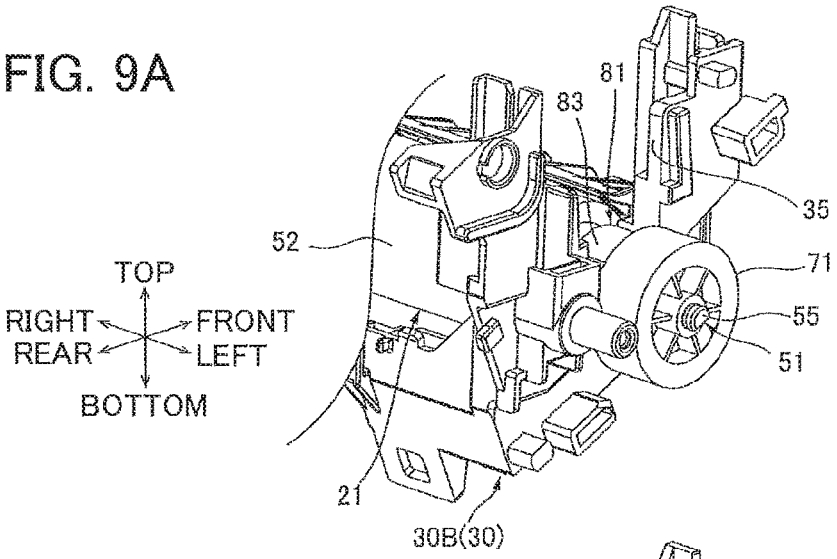
FIG. 9A is a perspective view of a left end portion of a lower frame, a left end portion of a pressure roller and a fixing member of a printer according to a second embodiment of the present disclosure, in which the pressure roller and the fixing member are assembled to the lower frame.
Figure 9B:
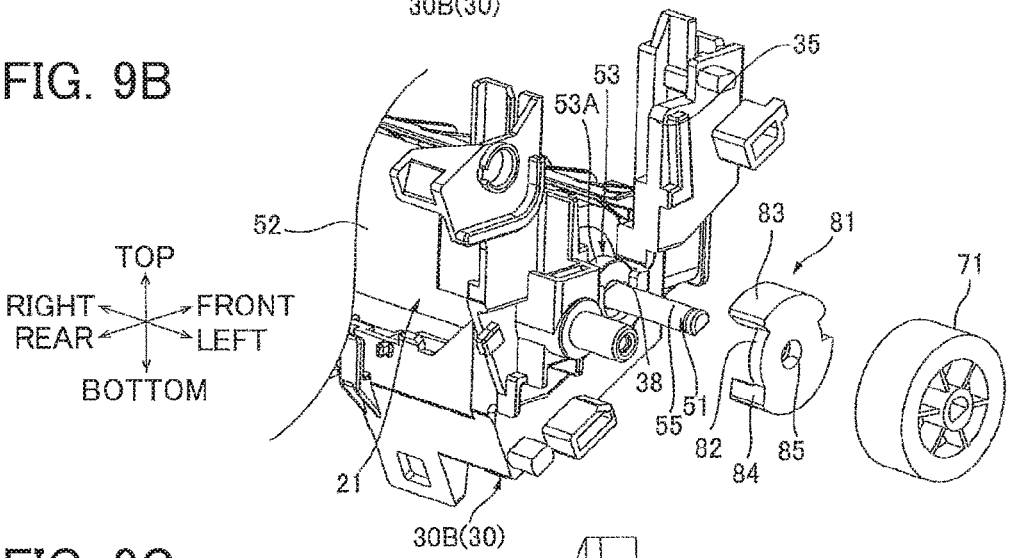
FIG. 9B is a perspective view of the lower frame, the pressure roller and the fixing member illustrated in FIG. 9A, in which the fixing member is separated from the lower frame.

In the second embodiment, as illustrated in FIG. 9B, a pair of fixing members 81 respectively contacts the pair of bearing portions 53 of the pressure roller 21. Each of the pair of fixing members 81 has a substantially cylindrical shape.

Specifically, in the second embodiment, the fixing unit 5 includes the pair of fixing members 81 in place of the pair of fixing members 41.

Figure 9C:
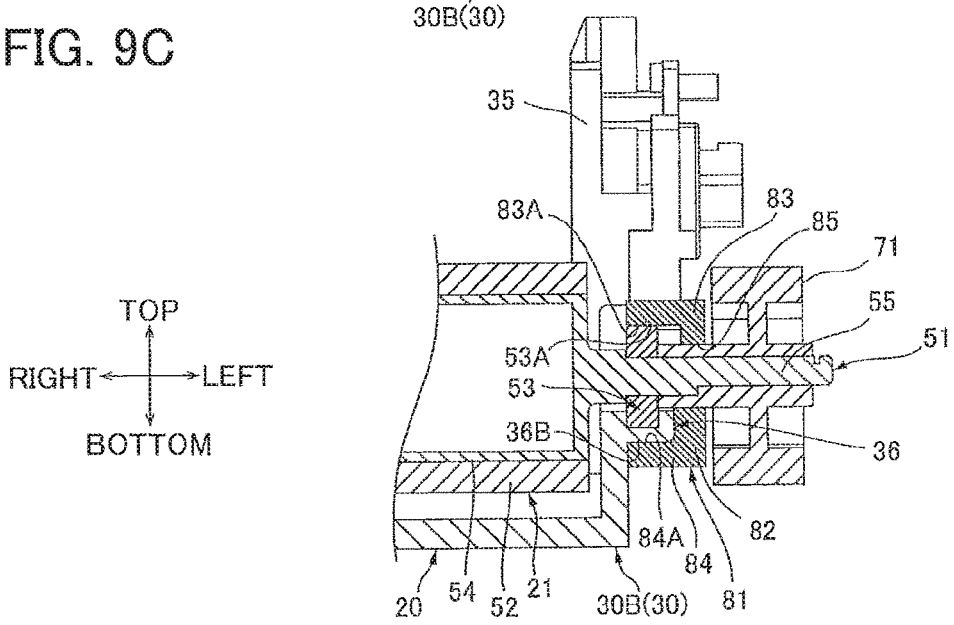
FIG. 9C is a cross-sectional view of the lower frame, the pressure roller and the fixing member illustrated in FIG. 9A as viewed from a rear side thereof.

As illustrated in FIGS. 9A and 9C, the pair of fixing members 81 is respectively disposed at both end portions of the lower frame 20 in the left-right direction. Specifically, each of the pair of fixing members 81 is disposed so as to surround the support portion 36 and the bearing portion 53. Each of the pair of fixing members 81 has a substantially cylindrical shape with a thickness in the left-right direction. Each of the pair of fixing members 81 includes a plate portion 82, an upper engagement portion 83, and a lower engagement portion 84. Incidentally, in the second embodiment, the upper engagement portion 83 and the plate portion 82 are an example of a first portion, and the lower engagement portion 84 is an example of a second portion.

The plate portion 82 constitutes an outer left-right end portion of each of the pair of fixing members 81. The plate portion 82 has a substantially disk shape with a thickness in the left-right direction. The plate portion 82 is formed with an insertion hole 85.

The insertion hole 85 is disposed at a center portion of the plate portion 82. The insertion hole 85 has a substantially circular shape in a side view and penetrates the plate portion 82 in the left-right direction. The small diameter portion 55 of the pressure roller 21 is inserted through the insertion hole 85.

The upper engagement portion 83 constitutes an upper end portion of each of the pair of fixing members 81. The upper engagement portion 83 extends inward in the left-right direction from an upper end portion of the plate portion 82. The upper engagement portion 83 has a substantially rectangular shape in a plan view and has a substantial plate shape that curves upward. The upper engagement portion 83 is disposed above the bearing portion 53 such that a lower surface 83A of the upper engagement portion 83 is in contact with the upper surface 53A of the bearing portion 53. In other words, the upper engagement portion 83 engages with the shaft portion 51 through the bearing portion 53.

The lower engagement portion 84 constitutes a lower end portion of each of the pair of fixing members 81. The lower engagement portion 84 extends inward in the left-right direction from a lower end portion of the plate portion 82. The lower engagement portion 84 has a substantially rectangular shape in a bottom view and has a substantial plate shape that curves downward. The lower engagement portion 84 is disposed below the support portion 36 such that an upper surface 84A of the lower engagement portion 84 is in contact with a lower surface 36B of the support portion 36 of the side wall 30. In other words, the lower engagement portion 84 engages with the support portion 36 at a position where the lower engagement portion 84 faces the bearing portion 53, with the support portion 36 interposed between the lower engagement portion 84 and the bearing portion 53.

Similarly to the first embodiment described above, when an upward force is applied to the pressure gear 71 upon transmission of the drive force to the pressure gear 71, an upward force is applied to the pair of bearing portions 53 through the shaft portion 51. Then, the pair of bearing portions 53 applies an upward force to the pair of fixing members 81. Particularly, the left bearing portion 53 applies the upward force to the left fixing member 81.

Meanwhile, the upper surface 84A of the lower engagement portion 84 of each of the pair of fixing members 81 engages with the lower surface 36B of the support portion 36 of the pair of side walls 30. As a result, upward movement of each of the pair of fixing members 81 is restricted. Hence, the upper engagement portion 83 of each of the pair of fixing members 81 restricts upward movement of each of the pair of bearing portions 53. Particularly, the upper engagement portion 83 of the left fixing member 81 restricts the left bearing portion 53 from moving upward. In this way, upward movement of the pressure roller 21 is restricted, thereby fixing the pressure roller 21 in a predetermined position in the vertical direction. Hence, the pressure roller 21 can be fixed in position relative to the heating unit 22.

(1-2) Operational Effects of Second Embodiment

The printer 1 according to the second embodiment can obtain the same operational advantages described above in the first embodiment.

Further, according to the printer 1 of the second embodiment, as illustrated in FIG. 9C, the pair of fixing members 81 has a substantially cylindrical shape and is disposed so as to surround the pair of bearing portions 53, respectively. Further, the upper engagement portion 83 is disposed above the bearing portion 53 while the lower engagement portion 84 is disposed below the bearing portion 53.

With this configuration, when the upward force is applied to each of the pair of bearing portions 53, the lower surface 83A of the upper engagement portion 83 can reliably engage with the upper surface 53A of the bearing portion 53 while the upper surface 84A of the lower engagement portion 84 can reliably engage with the lower surface 36B of the support portion 36 of the side wall 30.

As a result, the upward movement of the pair of bearing portions 53 can be reliably restricted by the pair of fixing members 81, thereby reliably fixing the pressure roller 21 in the predetermined position.

(2) Third Embodiment

A third embodiment will be described while referring to FIGS. 10A and 10B, wherein like parts and components are designated with the same reference numerals to avoid duplicating description. In the following description, only parts differing from those of the first embodiment will be described in detail.

(2-1) Detailed Description of Fixing Unit According to Third Embodiment

In the first embodiment described above, the fixing unit 5 includes the pair of fixing members 41. The pair of bearing portions 53 engages with the pair of fixing members 41, respectively, thereby fixing the pressure roller 21 in the predetermined position.

Figure 10A:
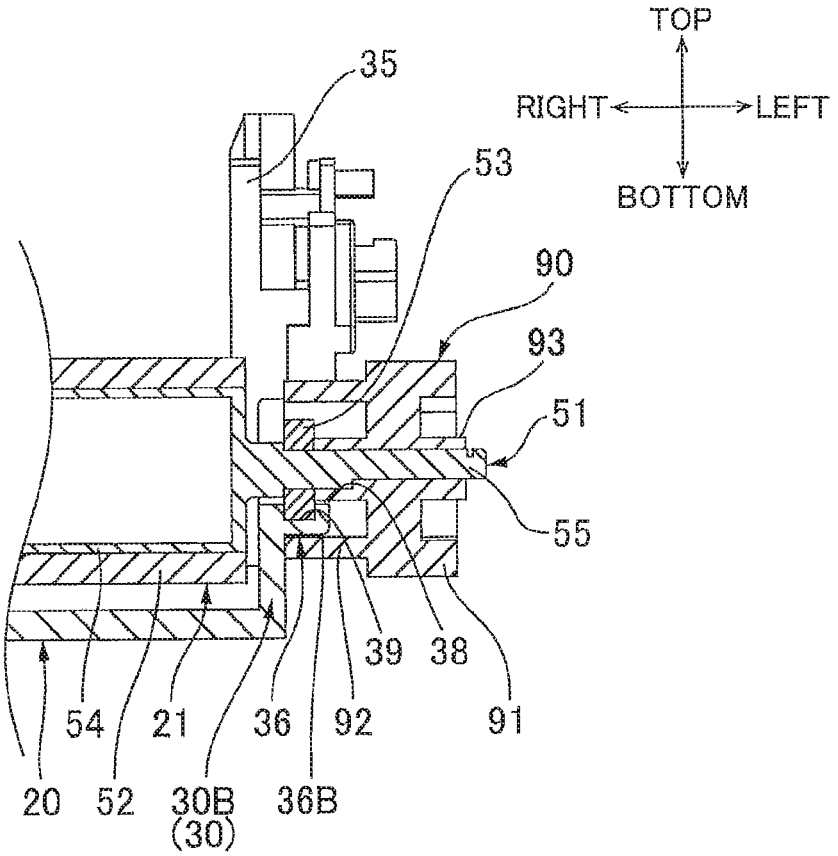
FIG. 10A is a cross-sectional view of a left end portion of a lower frame, a left end portion of a pressure roller and a pressure gear of a printer according to a third embodiment of the present disclosure as viewed from a rear side thereof.

In the third embodiment, as illustrated in FIG. 10A, the pair of fixing members 41 is not provided in the fixing unit 5. In the third embodiment, a pressure gear 90 also serves as a fixing member.

Figure 10B:
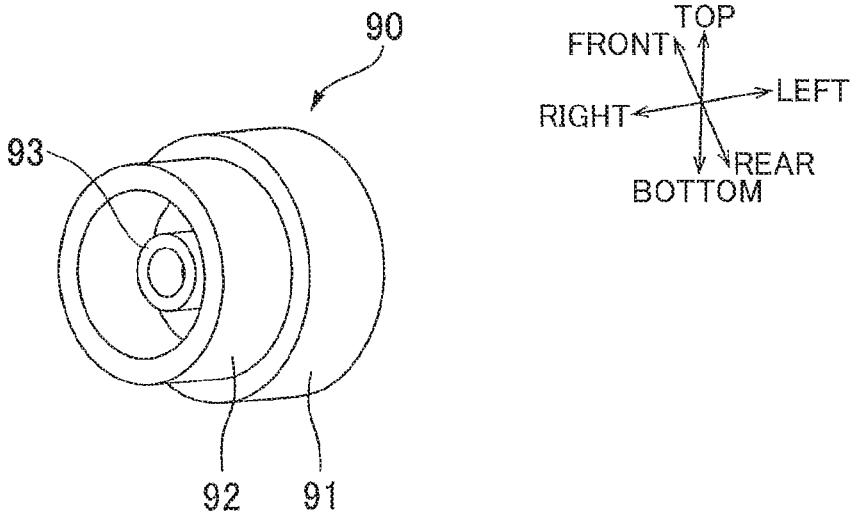
FIG. 10B is a perspective view of the pressure gear illustrated in FIG. 10A as viewed from an upper right side thereof.

Specifically, in the third embodiment, as illustrated in FIG. 10B, the pressure gear 90 integrally includes a gear portion 91, an engagement portion 92, and a shaft receiving portion 93.

The gear portion 91 constitutes a right end portion of the pressure gear 90. The gear portion 91 has a substantially cylindrical shape with a thickness in the left-right direction. Gear teeth are provided on an outer peripheral surface in its entirety of the gear portion 91. The gear portion 91 meshedly engages with the drive gear 70.

The engagement portion 92 protrudes rightward from a right surface of the gear portion 91. The engagement portion 92 has a substantially cylindrical shape with a thickness in the left-right direction. A lower portion of the engagement portion 92 is disposed below the support portion 36 such that a lower inner peripheral surface of the engagement portion 92 is in contact with the lower surface 36B of the support portion 36 of the left side wall 30B from below. In other words, the lower portion of the engagement portion 92 engages with the support portion 36 at a position where the lower portion of the engagement portion 92 faces the bearing portion 53, with the support portion 36 interposed between the lower portion of the engagement portion 92 and the bearing portion 53. The engagement portion 92 is an example of a second portion.

The shaft receiving portion 93 extends through the gear portion 91 and the engagement portion 92, and receives the left small diameter portion 55 of the shaft portion 51 of the pressure roller 21 so as not to be rotatable relative thereto. That is, an inner peripheral surface of the shaft receiving portion 93 engages with the outer peripheral surface of the shaft portion 51. The inner peripheral surface of the shaft receiving portion 93 is an example of a first portion.

When an upward force is applied to the pressure gear 90 upon transmission of the drive force to the pressure gear 90, the lower inner peripheral surface of the engagement portion 92 of the pressure gear 90 engages with the lower surface 36B of the support portion 36 of the left side wall 30B. Hence, upward movement of the pressure gear 90 is restricted. Accordingly, upward movement of the shaft portion 51 is restricted. Thus, upward movement of the pressure roller 21 is restricted, thereby fixing the pressure roller 21 in a predetermined position in the vertical direction. Hence, the pressure roller 21 can be fixed in position relative to the heating unit 22.

(2-2) Operational Effects of Third Embodiment

The printer 1 according to the third embodiment can obtain the same operational advantages described above in the first embodiment.

Further, according to the printer 1 of the third embodiment, as illustrated in FIG. 10A, when the upward force is applied to the pressure gear 90, the lower end portion of the engagement portion 92 of the pressure gear 90 engages with the lower surface 36B of the support portion 36 of the left side wall 30B. Hence, the upward movement of the pressure gear 90 is restricted.

Accordingly, the upward movement of the shaft portion 51 is restricted. Thus, the upward movement of the pressure roller 21 is restricted, thereby fixing the pressure roller 21 in the predetermined position in the vertical direction.

As a result, the pressure roller 21 can be fixed in position with a simple configuration. Further, the number of components of the printer 1 can be decreased.

(3) Fourth Embodiment

A fourth embodiment will be described while referring to FIGS. 11A and 11B, wherein like parts and components are designated with the same reference numerals to avoid duplicating description. In the following description, only parts differing from those of the first embodiment will be described in detail.

(3-1) Detailed Description of Fixing Unit According to Fourth Embodiment

In the first embodiment described above, the fixing unit 5 includes the pair of fixing members 41. The pair of fixing members 41 engages with the pair of bearing portions 53, respectively, thereby fixing the pressure roller 21 in position.

Figure 11A:
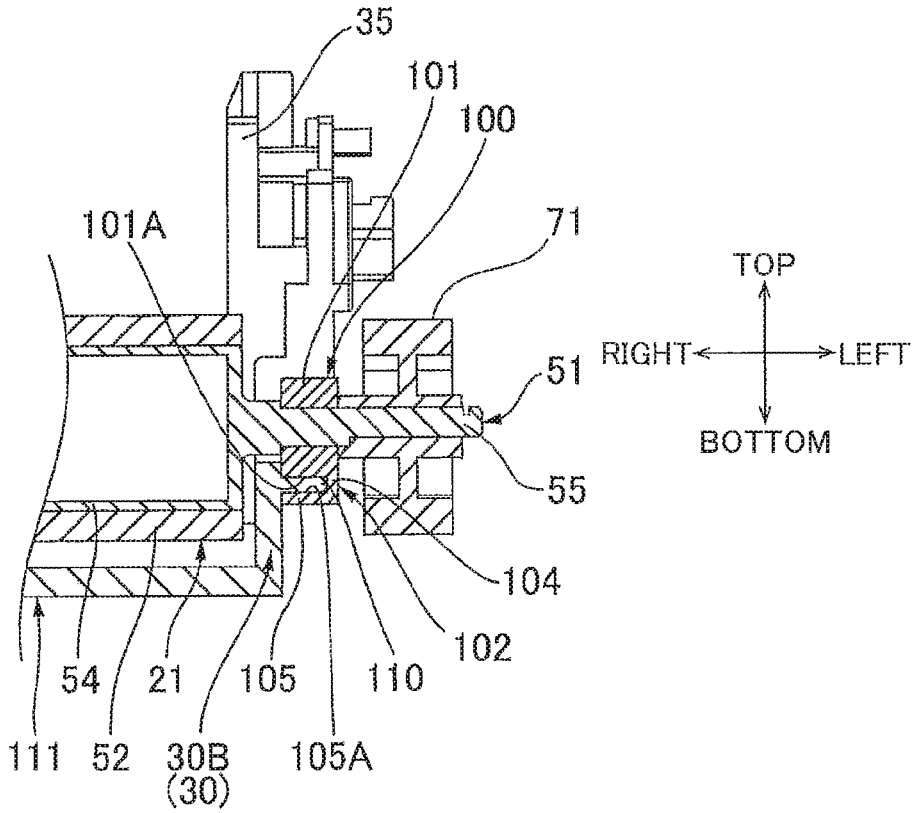
FIG. 11A is a cross-sectional view of a left end portion of a lower frame, a left end portion of a pressure roller, a bearing portion of a printer according to a fourth embodiment of the present disclosure as viewed from a rear side thereof.

In the fourth embodiment, as illustrated in FIG. 11A, the pair of fixing members 41 is not provided in the fixing unit 5. In the fourth embodiment, each of a pair of bearing portions 100 also serves as a fixing member.

Specifically, in the fourth embodiment, a lower frame 111 of the fixing unit 5 includes a pair of protrusion portions 110 in place of the support portions 36. The pair of protrusion portions 110 is an example of a support portion. The lower frame 111 is an example of a second frame.

Each of the pair of protrusion portions 110 protrudes outward in the left-right direction from an outer left-right surface of each of the pair of side walls 30. Each of the pair of protrusion portions 110 has a substantially rectangular shape in a plan view and has a substantial plate shape that curves downward.

Figure 11B:
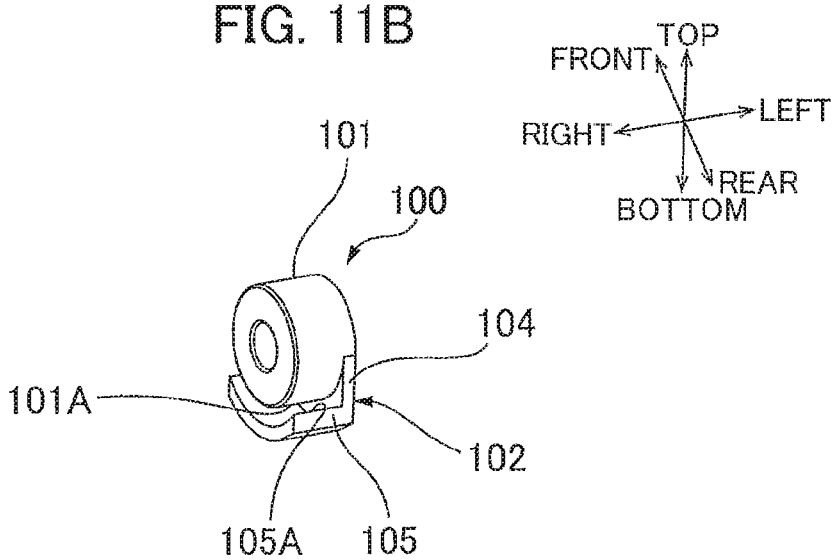
FIG. 11B is a perspective view of the bearing portion illustrated in FIG. 11A as viewed from an upper right side thereof.

As illustrated in FIG. 11B, each of the pair of bearing portions 100 integrally includes an insertion portion 101 as an example of a first portion and an engagement portion 102 as an example of a second portion.

The insertion portion 101 has a substantially cylindrical shape with a thickness in the left-right direction. The insertion portion 101 has an annular shape in a side view. An inner diameter of the insertion portion 101 is substantially equal to the outer diameter of the small diameter portion 55. The insertion portion 101 is placed on the protrusion portion 110 of the side wall 30 and receives the small diameter portion 55 of the shaft portion 51 so as to be rotatable relative thereto. The insertion portion 101 is disposed above the protrusion portion 110 such that a lower surface 101A of the insertion portion 101 is in contact with an upper surface of the protrusion portion 110 of the side wall 30 from above.

The engagement portion 102 protrudes downward from a lower end of the insertion portion 101. The engagement portion 102 has a substantial L-shape in a front view. The engagement portion 102 includes a vertical plate portion 104 and a horizontal plate portion 105.

The vertical plate portion 104 protrudes downward from an outer left-right end portion of the insertion portion 101. The vertical plate portion 104 has a substantial plate shape extending in the vertical direction.

The horizontal plate portion 105 is disposed below the insertion portion 101 with a gap therebetween. The horizontal plate portion 105 protrudes inward in the left-right direction from a lower end portion of the vertical plate portion 104. The horizontal plate portion 105 has a substantially rectangular shape in a plan view and has a substantial plate shape that curves downward. The horizontal plate portion 105 is disposed below the protrusion portion 110 such that an upper surface 105A of the horizontal plate portion 105 is in contact with a lower surface of the protrusion portion 110 of the side wall 30 from below. The protrusion portion 110 is disposed between the lower surface 101A of the insertion portion 101 and the upper surface 105A of the horizontal plate portion 105 in the vertical direction. In other words, the engagement portion 102 engages with the protrusion portion 110 at a position where the horizontal plate portion 105 of the engagement portion 102 faces the insertion portion 101, with the protrusion portion 110 interposed between the insertion portion 101 and the horizontal plate portion 105.

When an upward force is applied to the pressure gear 71 upon transmission of the drive force to the pressure gear 71, an upward force is applied to the pair of bearing portions 100, particularly, the left bearing portion 100, through the shaft portion 51.

Meanwhile, the upper surface 105A of the horizontal plate portion 105 of each of the pair of bearing portions 100 engages with the protrusion portion 110 of each of the pair of side walls 30. Particularly, the upper surface 105A of the horizontal plate portion 105 of the left bearing portion 100 engages with the protrusion portion 110 of the left side wall 30B. As a result, upward movement of the pair of bearing portions 100 is restricted. Accordingly, upward movement of the pressure roller 21 is restricted, thereby fixing the pressure roller 21 is fixed in a predetermined position in the vertical direction. Hence, the pressure roller 21 can be fixed in position relative to the heating unit 22.

(3-2) Operational Effects of Fourth Embodiment

The printer 1 according to the fourth embodiment can obtain the same operational advantages described above in the first embodiment.

Further, according to the printer 1 of the fourth embodiment, as illustrated in FIG. 11A, when the upward force is applied to the pressure gear 71, the upper surface 105A of the horizontal plate portion 105 of each of the pair of bearing portions 100 engages with the protrusion portion 110 of each of the pair of side walls 30. Particularly, the upper surface 105A of the horizontal plate portion 105 of the left bearing portion 100 engages with the protrusion portion 110 of the left side wall 30B. Hence, the upward movement of the pair of bearing portions 110 is restricted.

Accordingly, the upward movement of the shaft portion 51 is restricted. Thus, the upward movement of the pressure roller 21 is restricted, thereby fixing the pressure roller 21 in the predetermined position in the vertical direction.

As a result, the pressure roller 21 can be fixed in position with a simple configuration. Further, the number of components of the printer 1 can be decreased.

(4) Fifth Embodiment

A fifth embodiment will be described while referring to FIGS. 12A and 12B, wherein like parts and components are designated with the same reference numerals to avoid duplicating description. In the following description, only parts differing from those of the first embodiment will be described in detail.

(4-1) Detailed Description of Fixing Unit According to Fifth Embodiment

In the first embodiment described above, the pair of fixing members 41 is in contact with the pair of bearing portions 53 of the pressure roller 21, respectively.

Figure 12A:
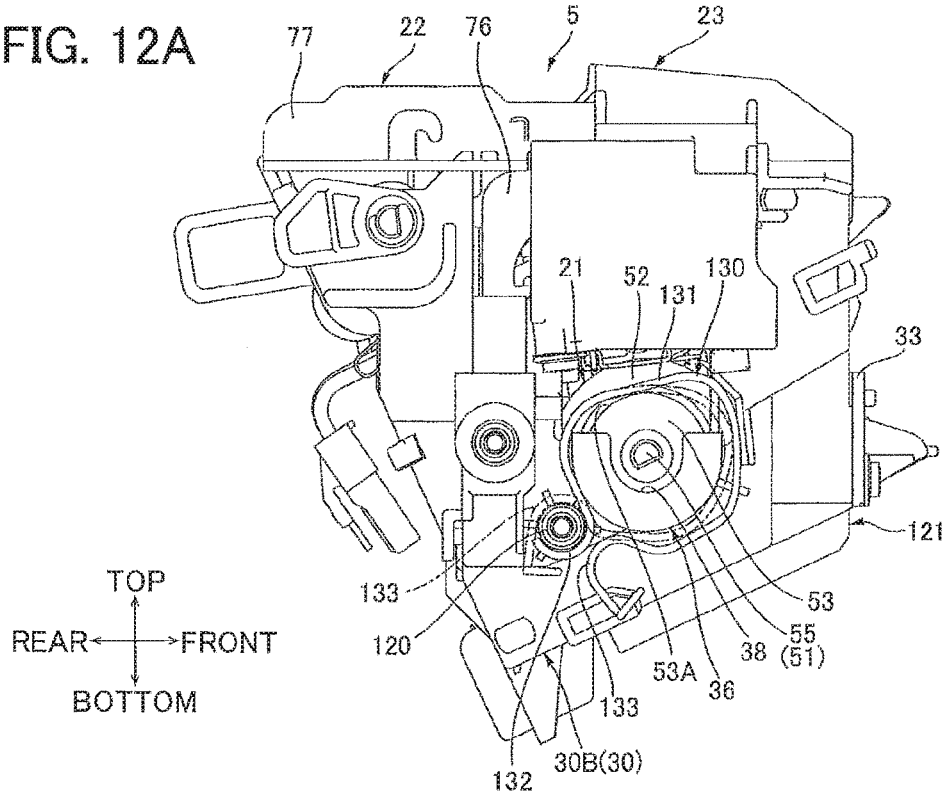
FIG. 12A is a left side view of a lower frame and a spring of a printer according to a fifth embodiment of the present disclosure, in which the spring is about to be completely attached to a side wall of the lower frame.
Figure 12B:
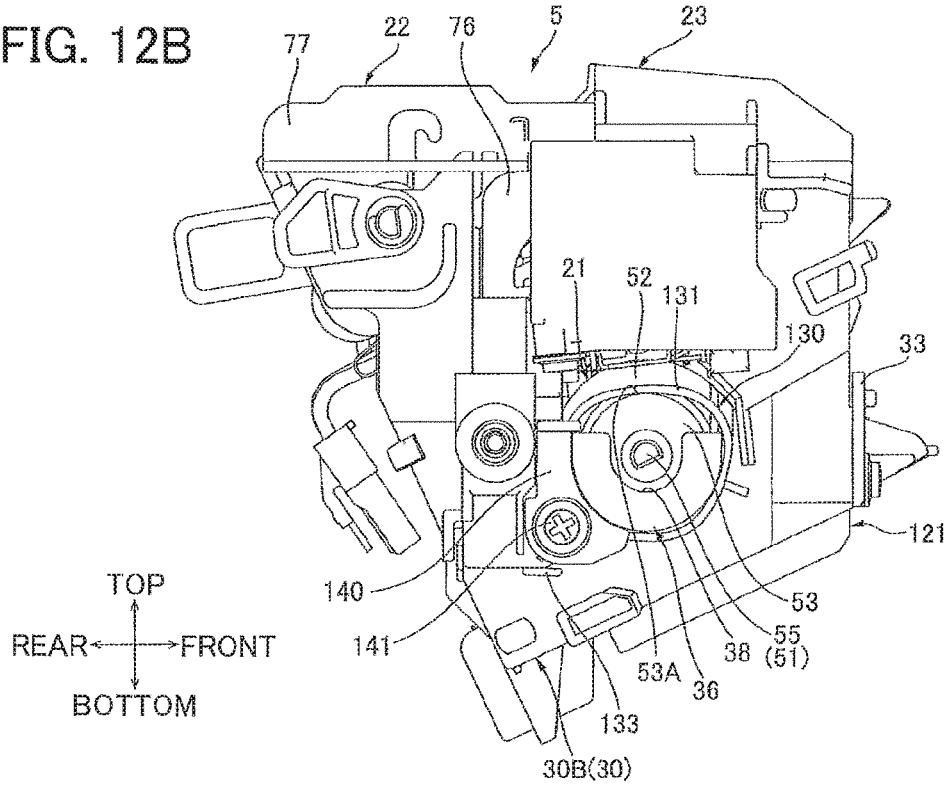
FIG. 12B is a left side view of the lower frame and the spring of the printer according the fifth embodiment, in which the spring has been completely attached to the side wall.

In the fifth embodiment, as illustrated in FIG. 12B, a pair of springs 130 is in contact with the pair of bearing portions 53 of the pressure roller 21, respectively.

Specifically, in the fifth embodiment, the fixing unit 5 includes the pair of springs 130 as an example of a fixing member in place of the pair of fixing members 41.

As illustrated in FIGS. 12A and 12B, the pair of springs 130 is respectively disposed at both end portions of a lower frame 121 as an example of a second frame of the fixing unit 5 in the left-right direction. Specifically, the pair of springs 130 is respectively disposed so as to surround the support portions 36 of the lower frame 121 and the pair of bearing portions 53. Each of the pair of springs 130 is formed of metal and has a substantially annular shape. Each of the pair of springs 130 includes a contact portion 131, a first attachment portion 132, and a second attachment portion 133. Incidentally, in the fifth embodiment, the contact portion 131 is an example of a first portion, and the first attachment portion 132 and the second attachment portion 133 are an example of a second portion.

The contact portion 131 constitutes an intermediate portion of each of the pair of springs 130 and has a substantially annular shape. The contact portion 131 is disposed so as to surround the support portion 36 and the bearing portion 53. That is, a portion of the contact portion 131 is disposed above the support portion 36 and the bearing portion 53.

The first attachment portion 132 constitutes one end portion of each of the pair of springs 130 and is disposed at a lower rear side of the contact portion 131. The first attachment portion 132 has a substantially semi-annular shape and is continuous to a lower rear end of the contact portion 131. Specifically, the first attachment portion 132 is curved into a substantially semi-annular shape so as to protrude forward and downward from the lower rear end of the contact portion 131.

The second attachment portion 133 constitutes the other end portion of each of the pair of springs 130 and is disposed at a lower rear side of the contact portion 131. The second attachment portion 133 has a substantially semi-annular shape and is continuous to a lower end of the contact portion 131. Specifically, the second attachment portion 133 is curved into a substantially semi-annular shape so as to protrude rearward and upward from the lower end of the contact portion 131.

Further, each of the pair of side walls 30 of the lower frame 121 includes a boss 120 as an example of a projecting portion.

The boss 120 is disposed at the lower rear end of the side wall 30. The boss 120 protrudes outward in the left-right direction from an outer left-right surface of the side wall 30.

When the pair of springs 130 is respectively assembled to the pair of side walls 30, first, the first attachment portions 132 of the pair of springs 130 engage with the bosses 120 of the pair of side walls 30, respectively, in a state where the pair of side walls 30 supports the pressure roller 21.

Next, as indicated by an imaginary line of FIG. 12A, the second attachment portions 133 of the pair of springs 130 engage with the bosses 120 of the pair of side walls 30, respectively.

Then, the contact portions 131 of the pair of springs 130 contact the upper surfaces 53A of the bearing portions 53 from above, respectively, so as to press the upper surfaces 53A of the bearing portions 53 downward.

Subsequently, as illustrated in FIG. 12B, outer left-right portions of the pair of springs 130 are respectively covered by a pair of covers 140. Each of the pair of covers 140 has a substantially rectangular shape in a side view.

Thereafter, the pair of covers 140 is attached to the pair of side walls 30, respectively, by fixing a pair of screws 141 to the bosses 120, respectively.

In a state where the pair of springs 130 is respectively assembled to the pair of side walls 30, a portion of the contact portion 131 of each of the pair of springs 130 is disposed above the shaft portion 51 and engages with the shaft portion 51 through the bearing portion 53, while the first attachment portion 132 and the second attachment portion 133 of each of the pair of springs 130 engage with the boss 120 of the lower frame 121. In other words, the first attachment portion 132 and the second attachment portion 133 engage with the boss 120 at a position offset from the contact portion 131 in the front-rear direction.

In this way, in the fixing unit 5 in which the pair of springs 130 is respectively assembled, when an upward force is applied to the pressure gear 71 upon transmission of the drive force to the pressure gear 71, an upward force is applied to the pair of bearing portions 53 through the shaft portion 51 similarly to the first embodiment described above. Then, the pair of bearing portions 53 applies an upward force to the pair of springs 130. Particularly, the left bearing portion 53 applies the upward force to the left spring 130.

Meanwhile, the first attachment portion 132 and the second attachment portion 133 of each of the pair of springs 130 engage with the boss 120, as illustrated in FIG. 12A. As a result, upward movement of each of the pair of springs 130 is restricted. Hence, each of the pair of springs 130 restricts upward movement of each of the pair of bearing portions 53. Particularly, the contact portion 131 of the left spring 130 restricts upward movement of the left bearing portion 53. In this way, upward movement of the pressure roller 21 is restricted, thereby fixing the pressure roller 21 in a predetermined position in the vertical direction. Hence, the pressure roller 21 can be fixed in position relative to the heating unit 22.

(4-2) Operational Effects of Fifth Embodiment

The printer 1 according to the fifth embodiment can obtain the same operational advantages described above in the first embodiment.

Further, according to the printer 1 of the fifth embodiment, as illustrated in FIG. 12A, the first attachment portion 132 and the second attachment portion 133 of each of the pair of springs 130 engage with the boss 120. Further, the contact portion 131 of each of the pair of springs 130 is disposed so as to surround the support portion 36 and the bearing portion 53.

With this configuration, when the upward force is applied to each of the pair of bearing portions 53, the upward movement of each of the pair of springs 130 is restricted, since the first attachment portion 132 and the second attachment portion 133 of each of the pair of springs 130 engages with the boss 120.

As a result, the upward movement of the pair of bearing portions 53 can be reliably restricted by the contact portions 131 of the pair of springs 130.

Therefore, the pressure roller 21 can be reliably fixed in position by the pair of springs 130.

While the description has been made in detail with reference to the embodiments thereof, it would be apparent to those skilled in the art that many modifications and variations may be made therein without departing from the spirit of the present disclosure.

What is claimed is:

1. An image forming apparatus comprising:

a heating unit including a heater and extending in a first direction;

a pressure roller including a shaft portion and a roller portion, the shaft portion extending in the first direction and having one end portion in the first direction, the shaft portion having an outer peripheral surface, the roller portion covering the outer peripheral surface of the shaft portion, the pressure roller being configured to convey a recording medium between the heating unit and the roller portion in a conveying direction;

a first frame supporting the heating unit;

a second frame engaging with the first frame and supporting the shaft portion;

a first gear provided at the one end portion of the shaft portion and configured to rotate with the pressure roller;

a second gear meshedly engaging with the first gear and configured to transmit a drive force to the first gear;

a fixing member having a first portion engaging with the shaft portion and a second portion engaging with the second frame, at least a part of the first portion engaging with the shaft portion at a position on a downstream side of the shaft portion in a second direction in which the shaft portion receives a force upon transmission of the drive force from the second gear to the first gear; and a bearing portion rotatably supporting the shaft portion, wherein at least the part of the first portion is disposed at a downstream side of the bearing portion in the second direction, and engages with the shaft portion through the bearing portion, wherein the second frame includes a support portion supporting the bearing portion, the support portion being disposed at an upstream side of the bearing portion in the second direction, and wherein the fixing member is formed of a spring to form into a substantially annular shape, the fixing member surrounding the bearing portion and the support portion, the first portion constituting an intermediate portion of the spring, the second portion constituting end portions of the spring.

2. The image forming apparatus according to claim 1, further comprising a bearing portion rotatably supporting the shaft portion, wherein at least the part of the first portion is disposed at a downstream side of the bearing portion in the second direction, and engages with the shaft portion through the bearing portion.

3. The image forming apparatus according to claim 2, wherein, in a third direction defined as a direction from a rotation axis of the first gear toward a rotation axis of the second gear, the second portion engages with the second frame at a position offset from the first portion.

4. The image forming apparatus according to claim 1, wherein the shaft portion has a center portion in the first direction, and wherein the fixing member is disposed closer to the one end portion of the shaft portion than to the center portion of the shaft portion in the first direction.

5. The image forming apparatus according to claim 1, wherein the second gear is disposed at an upstream side of the first gear in the conveying direction.

6. The image forming apparatus according to claim 1, wherein the heating unit is disposed at a downstream side of the pressure roller in the second direction.

7. The image forming apparatus according to claim 1, wherein the heating unit faces the pressure roller in a facing direction, and wherein the heating unit is movable between a first position where the heating unit is positioned close to the pressure roller in the facing direction and a second position where the heating unit is positioned away from the pressure roller in the facing direction farther than in the first position.

8. The image forming apparatus according to claim 1, wherein the heater has an outer peripheral surface, wherein the heating unit comprises:

an endless belt having a cylindrical shape and surrounding the outer peripheral surface of the heater; and a nip plate disposed between the endless belt and the heater, the nip plate nipping the endless belt in cooperation with the roller portion.

9. An image forming apparatus comprising:

a heating unit including a heater and extending in a first direction;

a pressure roller including a shaft portion and a roller portion, the shaft portion extending in the first direction and having one end portion in the first direction, the shaft portion having an outer peripheral surface, the roller portion covering the outer peripheral surface of the shaft portion, the pressure roller being configured to convey a recording medium between the heating unit and the roller portion in a conveying direction;

a first frame supporting the heating unit;

a second frame engaging with the first frame and supporting the shaft portion;

a first gear provided at the one end portion of the shaft portion and configured to rotate with the pressure roller;

a second gear meshedly engaging with the first gear and configured to transmit a drive force to the first gear;

a fixing member having a first portion engaging with the shaft portion and a second portion engaging with the second frame, at least a part of the first portion engaging with the shaft portion at a position on a downstream side of the shaft portion in a second direction in which the shaft portion receives a force upon transmission of the drive force from the second gear to the first gear, the second direction crossing the conveying direction; and a bearing portion rotatably supporting the shaft portion, wherein the second frame includes a support portion supporting the bearing portion, the support portion being disposed at an upstream side of the bearing portion in the second direction, wherein the second portion faces the bearing portion such that the support portion is interposed between the second portion and the bearing portion, the second portion being disposed at an upstream side of the support portion in the second direction and being in contact with the support portion, wherein the fixing member has a plate portion through which the shaft portion extends, the plate portion being disposed between the first gear and the bearing portion, the plate portion having an edge portion, and wherein the second portion is provided at the edge portion.

10. The image forming apparatus according to claim 9, wherein the second gear is disposed at an upstream side of the first gear in the conveying direction.

11. The image forming apparatus according to claim 9, wherein the heater has an outer peripheral surface, and wherein the heating unit comprises:

an endless belt having a cylindrical shape and surrounding the outer peripheral surface of the heater; and a nip plate disposed between the endless belt and the heater, the nip plate nipping the endless belt in cooperation with the roller portion.

12. An image forming apparatus comprising:

a heating unit including a heater and extending in a first direction;

a pressure roller including a shaft portion and a roller portion, the shaft portion extending in the first direction and having one end portion in the first direction, the shaft portion having an outer peripheral surface, the roller portion covering the outer peripheral surface of the shaft portion, the pressure roller being configured to convey a recording medium between the heating unit and the roller portion in a conveying direction;

a first frame supporting the heating unit;

a second frame engaging with the first frame and supporting the shaft portion;

a first gear provided at the one end portion of the shaft portion and configured to rotate with the pressure roller;

a second gear meshedly engaging with the first gear and configured to transmit a drive force to the first gear; and a fixing member having a first portion engaging with the shaft portion and a second portion engaging with the second frame, at least a part of the first portion engaging with the shaft portion at a position on a downstream side of the shaft portion in a second direction in which the shaft portion receives a force upon transmission of the drive force from the second gear to the first gear, wherein the first gear includes a gear portion having an outer peripheral surface on which gear teeth are provided, and wherein, in the first direction, a first distance from the first portion to the gear portion is smaller than a thickness of the gear portion.

13. The image forming apparatus according to claim 12, wherein the first portion and the second portion are disposed at a downstream side of the shaft portion in the second direction, and wherein the second portion engages with the second frame at two different positions offset from the first portion in a third direction defined as a direction from a rotation axis of the first gear toward a rotation axis of the second gear.

14. The image forming apparatus according to claim 12, further comprising a bearing portion rotatably supporting the shaft portion, wherein the second portion is integrally formed with the bearing portion.

15. The image forming apparatus according to claim 12, wherein the first gear includes a gear portion having an outer peripheral surface on which gear teeth are provided, and wherein, in the first direction, a first distance from the first portion to the gear portion is shorter than a second distance from the first portion to the roller portion.

16. The image forming apparatus according to claim 12, wherein the second gear is disposed at an upstream side of the first gear in the conveying direction.

17. The image forming apparatus according to claim 12, wherein the heating unit is disposed at a downstream side of the pressure roller in the second direction.

18. The image forming apparatus according to claim 12, wherein the heater has an outer peripheral surface, wherein the heating unit comprises:

an endless belt having a cylindrical shape and surrounding the outer peripheral surface of the heater; and a nip plate disposed between the endless belt and the heater, the nip plate nipping the endless belt in cooperation with the roller portion.

* * * * *